US010161200B2

(12) United States Patent
Nunes

(10) Patent No.: US 10,161,200 B2
(45) Date of Patent: Dec. 25, 2018

(54) HEAVE COMPENSATION SYSTEM

(71) Applicant: CAMERON INTERNATIONAL CORPORATION, Houston, TX (US)

(72) Inventor: Tiago Manuel Fernandes Nunes, Kristiansand S (NO)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/421,056

(22) Filed: Jan. 31, 2017

(65) Prior Publication Data

US 2018/0216421 A1 Aug. 2, 2018

(51) Int. Cl.
*E21B 19/00* (2006.01)
*E21B 15/02* (2006.01)

(52) U.S. Cl.
CPC ..... *E21B 19/006* (2013.01); *E21B 15/02* (2013.01)

(58) Field of Classification Search
CPC ..... E21B 19/006; E21B 15/02
See application file for complete search history.

(56) References Cited

U.S. PATENT DOCUMENTS 5,520,369 A * 5/1996 Chatard ..... B66C 13/02 254/277
2018/0171727 A1* 6/2018 Amaudric Du Chaffaut ..... E21B 19/006

* cited by examiner

*Primary Examiner* — James G Sayre
(74) *Attorney, Agent, or Firm* — Helene Raybaud

(57) ABSTRACT

A drilling system comprises a drilling vessel comprising a rig floor, a derrick extending from the rig floor of the drilling vessel along a longitudinal axis. The derrick comprises a first end disposed at the rig floor and a second end longitudinally spaced from the first end, and a heave compensation system disposed at the second end of the derrick. The heave compensation system comprises a support structure comprising a first laterally extending frame coupled to the second end of the derrick, and a second laterally extending frame spaced from the first frame, a crown block coupled to the support structure and a transport assembly coupled to the second frame of the support structure. The transport assembly comprises a first lifting lug and a cylinder assembly supported by the first frame, wherein the cylinder assembly is releasably coupled with the crown block and configured to longitudinally displace the crown block relative to the support structure in response to a heave movement of the vessel. The transport assembly is configured to releasably couple with the cylinder assembly via a cable extending through the first lifting lug, and to support the weight of the cylinder assembly in response to the cylinder assembly being lowered from the first lifting lug to the rig floor through an internal volume of the derrick.

12 Claims, 34 Drawing Sheets

HEAVE COMPENSATION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Drilling systems are sometimes utilized for the extraction of hydrocarbons from a subterranean earthen formation via a drilling wellbore into the formation. In some applications, drilling systems are located offshore and include a floating vessel disposed at the waterline, with a drillstring extending from the vessel to the subterranean wellbore. The operations of many floating vessels, such as semi-submersible drilling rigs, drill ships, and pipe-laying ships, are impeded by sea swell. Particularly, sea waves impart an up-and-down motion to a vessel, commonly referred to as "heave," with the period of the waves ranging anywhere from a few seconds up to about 30 seconds or so and the amplitude of the waves ranges from a few centimeters or inches up to about 15 meters (about 50 feet) or more. This up-and-down motion imparted to the vessel from the waves is then correspondingly imparted to any loads or structures attached to the vessel.

In particular, this heave motion of the loads or structures extending from the vessel is often highly undesirable, and even dangerous, to equipment and personnel. Heave compensation is directed to reducing the effect of this up-and-down motion on a load attached to the vessel. In particular, "passive" heave compensation systems are typically used by fixing the load to a point, such as the sea bed. Sea swell may then cause the vessel to move relative to the load, in which a passive compensator uses compressed air to provide a low frequency damping effect between the load and the vessel. Further, "active" heave compensation systems may be used that typically involve measuring the movement of the vessel using a measuring device, such as a motion reference unit ("MRU"), and using a signal from the MRU that represents the motion of the vessel to compensate for the motion.

SUMMARY

An embodiment of a drilling system comprises a drilling vessel comprising a rig floor, a derrick extending from the rig floor of the drilling vessel along a longitudinal axis, wherein the derrick comprises a first end disposed at the rig floor and a second end longitudinally spaced from the first end, a heave compensation system disposed at the second end of the derrick, the heave compensation system comprising: a support structure comprising a first laterally extending frame coupled to the second end of the derrick, and a second laterally extending frame spaced from the first frame, a crown block coupled to the support structure, a transport assembly coupled to the second frame of the support structure, wherein the transport assembly comprises a first lifting lug, and a cylinder assembly supported by the first frame, wherein the cylinder assembly is releasably coupled with the crown block and configured to longitudinally displace the crown block relative to the support structure in response to a heave movement of the vessel, wherein the transport assembly is configured to releasably couple with the cylinder assembly via a cable extending through the first lifting lug, and wherein the transport assembly is configured to support the weight of the cylinder assembly in response to the cylinder assembly being lowered from the first lifting lug to the rig floor through an internal volume of the derrick. In some embodiments, the transport assembly of the heave compensation system comprises a plurality of laterally spaced first support beams, wherein each first support beam extends longitudinally from the second frame of the support structure, and a laterally extending second support beam pivotably coupled to one of the plurality of laterally spaced first support beams, wherein the first lifting lug extends from the second support beam. In some embodiments, the laterally extending second support beam is configured to pivot to a position intersecting a longitudinal axis of the cylinder assembly. In some embodiments, the support structure comprises a longitudinal structure coupled to the first frame and the second frame. In certain embodiments, the longitudinal structure comprises a pair of angled support members coupled to the first frame and the second frame, and a cross-support member extending between the pair of angled support members, wherein the cross-support members is releasably coupled with the angled support members. In certain embodiments, the first frame of the support structure comprises a first open area configured to provide space for the cylinder assembly to be displaced therethrough in response to the cylinder assembly in response to the lowering of the cylinder assembly towards the rig floor. In some embodiments, the heave compensation system further comprises a pedestal member releasably coupled to both an end of the cylinder assembly and the first frame of the support structure, wherein the pedestal member is configured to be laterally displaced relative to the support structure in response to the cylinder assembly being lowered from the first lifting lug to the rig floor through the internal volume of the derrick. In some embodiments, the heave compensation system further comprises a vessel assembly supported by the first frame of the support structure, wherein the vessel assembly is configured to provide pressurized fluid to the cylinder assembly, wherein the transport assembly is configured to releasably couple with the vessel assembly via a cable extending through a second lifting lug of the transport assembly, and wherein the transport assembly is configured to support the weight of the vessel assembly in response to the vessel assembly being lowered from the second lifting lug to the rig floor through the internal volume of the derrick. In certain embodiments, the first frame of the support structure comprises a roller configured to guide the vessel assembly in response to the lowering of the vessel assembly towards the rig floor. In certain embodiments, the transport assembly of the heave compensation system comprises a plurality of laterally spaced first support beams, wherein each first support beam extends longitudinally from the second frame of the support structure, and a laterally extending third support beam disposed on the plurality of laterally spaced first support beams, wherein the second lifting lug extends from the third support beam. In some embodiments, the heave compensation system further comprises an active heave compensation actuator pivotably coupled to the crown block, wherein the actuator is configured to longitudinally displace the crown block relative to the support structure in response to a heave movement of the vessel, wherein the transport assembly is configured to releasably couple with the actuator via a cable extending through a third lifting lug of the transport assembly, and wherein the transport assembly is configured to support the weight of the cylinder assembly in response to the cylinder assembly being lowered from the third lifting lug to the rig floor through the internal volume of the derrick. In certain embodiments, the heave compensation system further comprises a pair of laterally spaced active heave support beams coupled to the second frame of the support structure, wherein each active heave support frame comprises a slot extending therein, and a guide plate coupled to the actuator, wherein, in response to the lowering of the actuator to the rig floor, the guide plate is configured to be displaced through the slots of the active heave support beams to guide the actuator towards the rig floor.

An embodiment of a method for removing a component of a heave compensation system comprises decoupling a cylinder assembly from a crown block, the cylinder assembly configured to displace the crown block in response to a heave motion of a drilling vessel supporting the heave compensation system, coupling the cylinder assembly to a support structure via a cable, and using the cable to lower the cylinder assembly through an internal volume of a derrick of the drilling vessel to a rig floor of the drilling vessel. In some embodiments the method further comprises displacing the cylinder assembly through an open area in a support frame of the support structure. In some embodiments the method further comprises engaging the cylinder assembly with a roller and a guide beam as the cylinder assembly is lowered to the rig floor. In certain embodiments the method further comprises decoupling a pedestal member from an end of the cylinder assembly and from a support frame of the support structure.

An embodiment of a method for removing a component of a heave compensation system comprises decoupling a cylinder of an active heave compensation actuator from a support structure, wherein the active heave compensation actuator is configured to displace a crown block relative to the support structure in response to a heave movement of a vessel supporting the heave compensation system, coupling a guide plate to the cylinder of the actuator, and displacing the guide plate through a slot extending into an actuator support beam of the support actuator to guide the displacement of the actuator through the support structure. In some embodiments the method further comprises coupling the actuator to the support structure via a cable, and using the cable to lower the actuator through an internal volume of a derrick of the drilling vessel to a rig floor of the drilling vessel. In some embodiments the method further comprises decoupling the actuator from a crown block. In certain embodiments the method further comprises decoupling a collar of the actuator from the actuator support beam.

BRIEF DESCRIPTION OF THE DRAWINGS

For a detailed description of exemplary embodiments, reference will now be made to the accompanying drawings in which.

DETAILED DESCRIPTION

Figure 1:
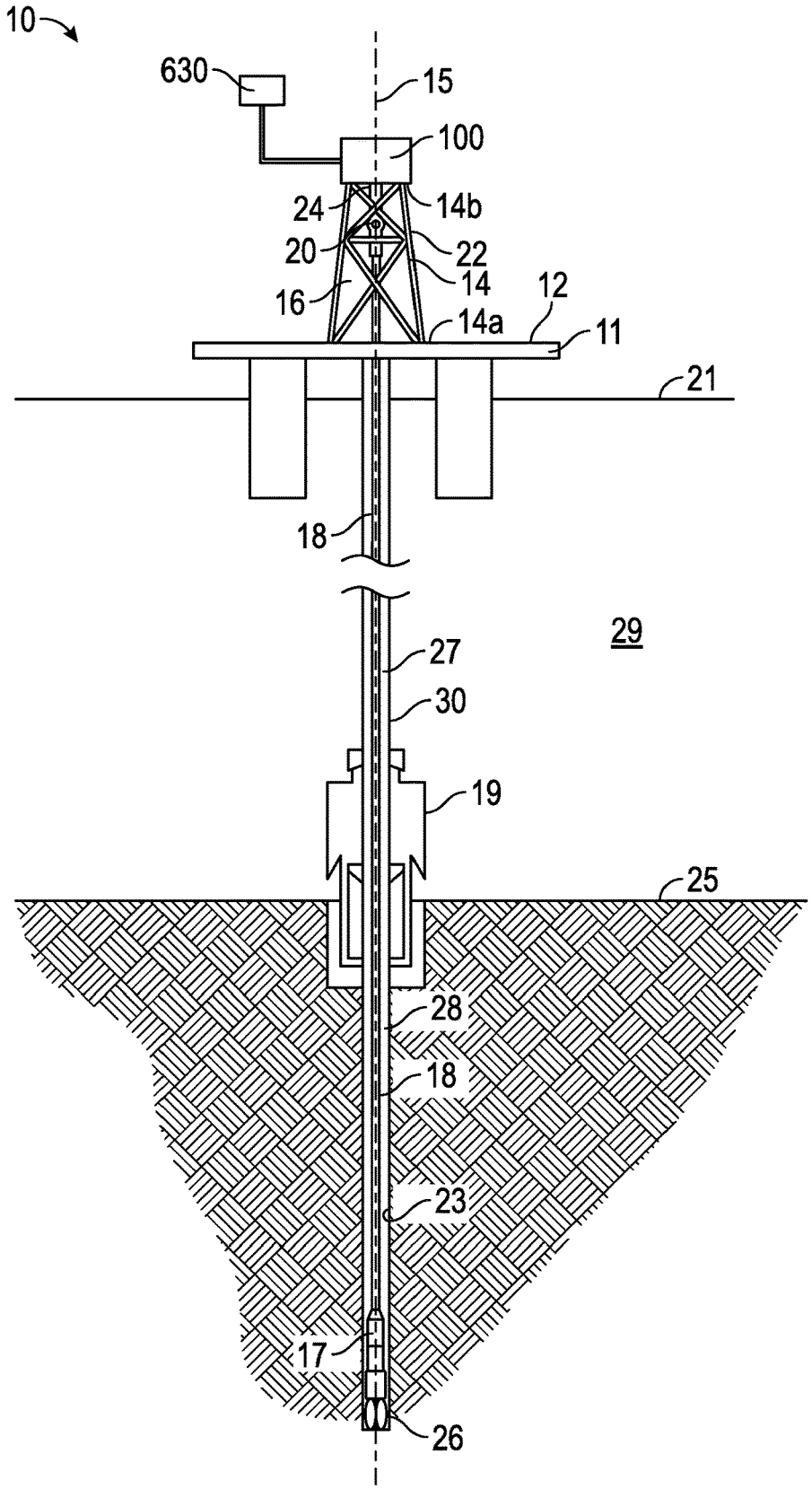
FIG. 1 is a schematic view of an embodiment of a drilling system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a schematic view of an offshore drilling system 10 including a heave compensation system 100 is shown. Drilling system 10 has a central or longitudinal axis 15 and generally includes a floating vessel or semi-submersible drilling rig 11 including a rig floor 12 and a derrick or mast 14. Although in this embodiment vessel 11 comprises a semi-submersible drilling rig, in other embodiments vessel 11 may comprise other types of vessels known in the art, including drilling ships and the like. In this embodiment, derrick 14 has a first or longitudinally (respective longitudinal axis 15) lower end 14*a* disposed at the rig floor 12, and a second or longitudinally upper end 14*b* longitudinally spaced from lower end 14*a*. In this arrangement, heave compensation system 100 of drilling system 10 is disposed at the longitudinally upper end 14*b* of derrick 14. Additionally, derrick 14 comprises a four-sided structure (only a single side shown in FIG. 1), with each side extending between the upper and lower longitudinal ends 14*a* and 14*b*. The volume encompassed within or defined by the four sides of derrick 14 forms a derrick volume or space 16.

Drilling system 10 additionally includes a string of drill pipes connected together by drill pipe joints or tubular members so as to form a drill string 18 extending subsea from platform 11. Enclosed within the derrick volume 16 is a travelling block 20 coupled with a drive 22 (e.g., a top drive). As will be discussed further herein, travelling block 20 is supported by a plurality of drilling cables 24 suspended from a crown block of heave compensation system 100, forming a block and tackle arrangement. Travelling block 20 and drive 22 are configured to longitudinally displace and apply torque, respectively, to a longitudinally upper end of drill string 18. Connected to the lower end of the drill string 18 is a bottom hole assembly (BHA) 17 and a drill bit 26. The bit 26 is rotated by rotating the drill string 18 via drive 22 and/or with a downhole motor (e.g., downhole mud motor) disposed in the BHA 17.

Drilling fluid, also referred to as drilling "mud," is pumped by mud recirculation equipment (e.g., mud pumps, shakers, etc.) (not shown) disposed on the rig floor 12 of vessel 11. Particularly, the drilling mud is pumped at a relatively high pressure and volume through a drilling kelly coupled with drive 22 and down the drill string 18 to the drill bit 26. The drilling mud exits the drill bit 26 through nozzles or jets in face of the drill bit 26. The mud then returns to the vessel 11 at the sea surface 21 via an annulus 28 between the drill string 18 and the borehole 23, through a blowout preventer (BOP) 19 at the sea floor 25, and up an annulus 27 between the drill string 18 and a riser 30 extending through the sea 29 from the blowout preventer 19 to the vessel 11. At the sea surface 21, the drilling mud is cleaned and then recirculated by the recirculation equipment. In some applications, the drilling mud is used to cool the drill bit 26, to carry cuttings from the base of the borehole to the vessel 11, and to balance the hydrostatic pressure in the subterranean formation extending beneath sea floor 25.

Figure 2A:
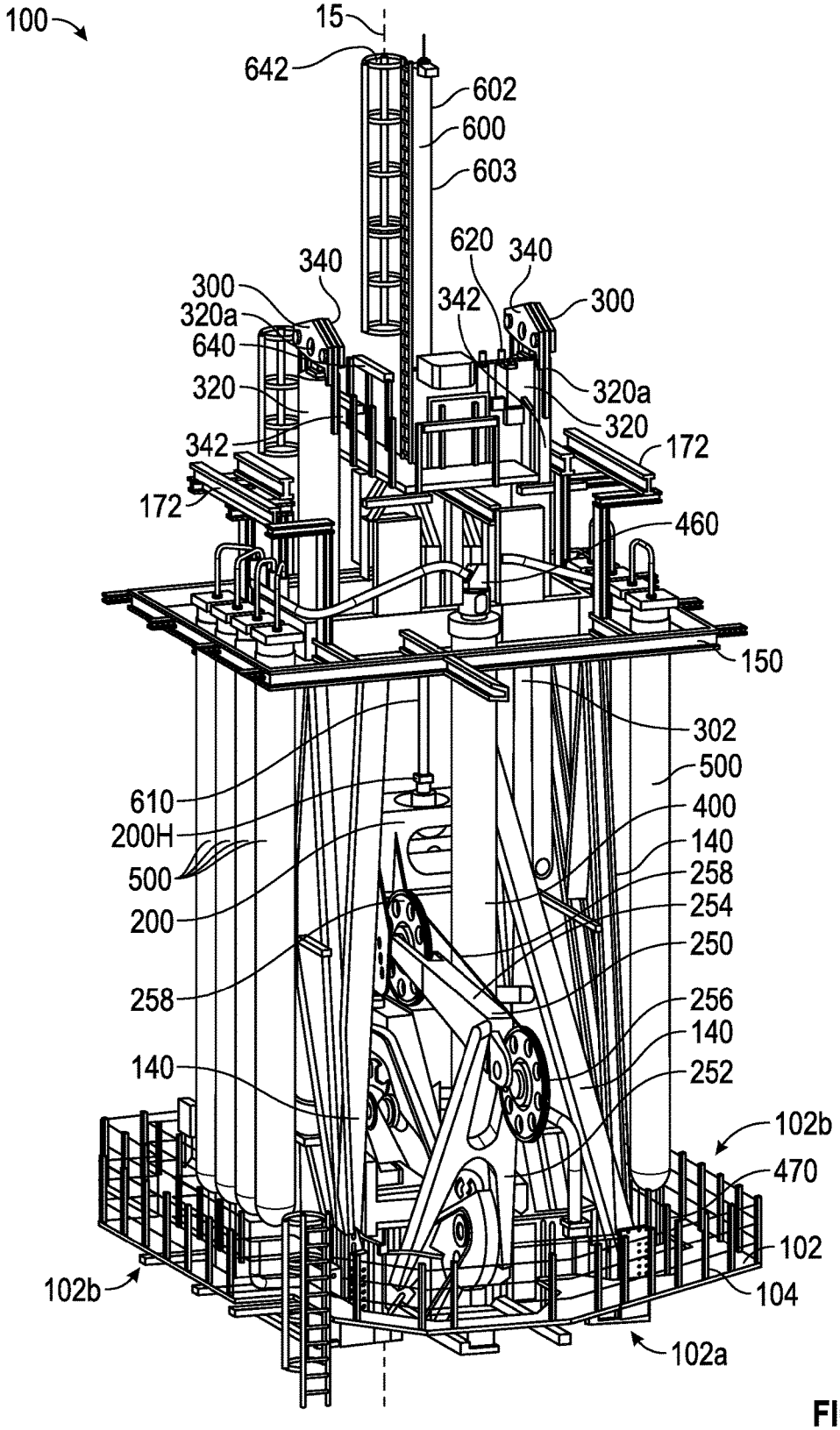
FIG. 2A is a perspective view of an embodiment of a heave compensation system of the drilling system of FIG. 1 in accordance with principles disclosed herein.
Figure 2B:
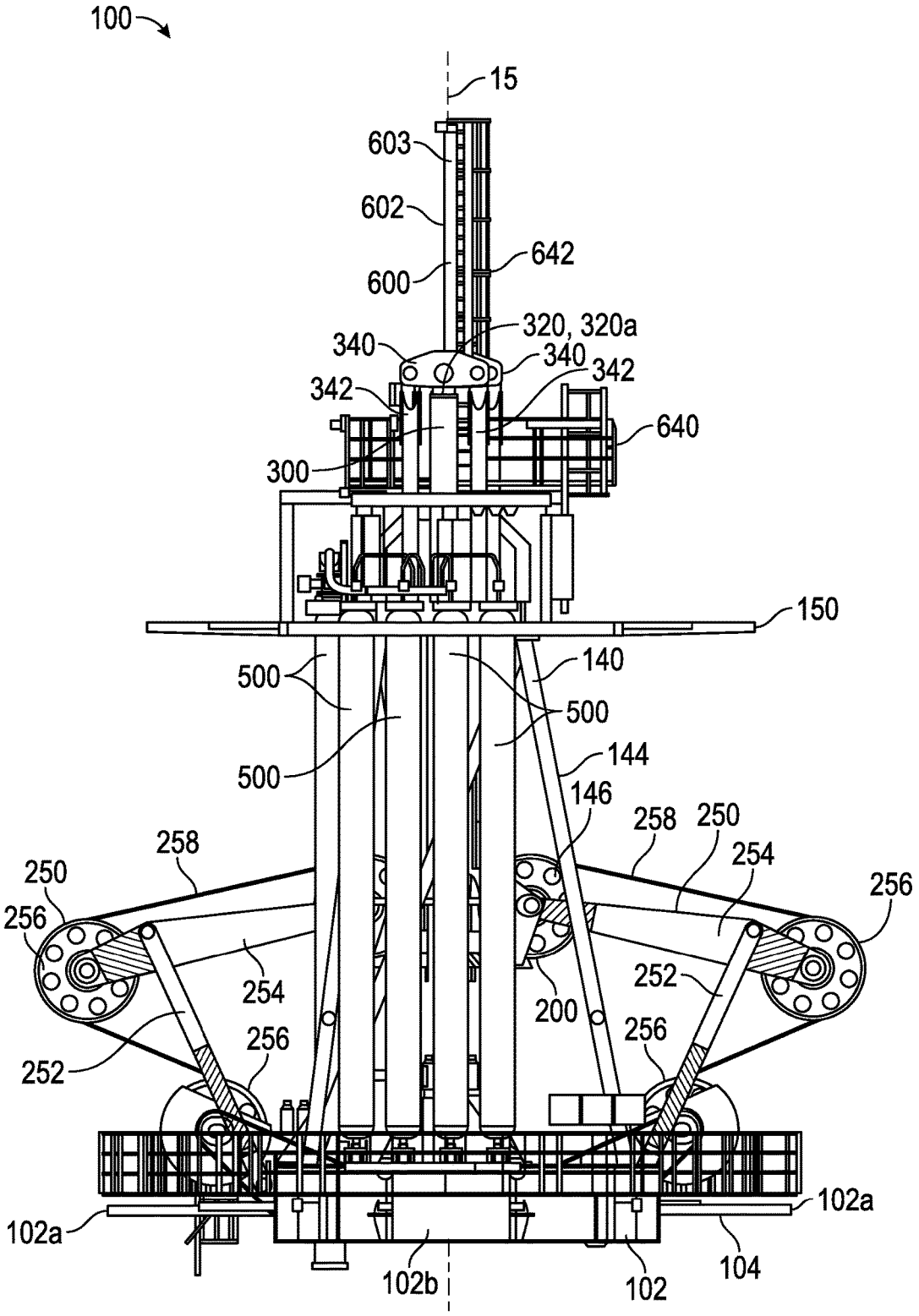
FIG. 2B is a side view of the heave compensation system of FIG. 2A.

Referring to FIGS. 1, 2A, and 2B, an embodiment of the heave compensation system 100 of FIG. 1 is shown. Heave compensation system 100 has a longitudinal axis coaxial with longitudinal axis 15 and is disposed at the longitudinally upper end 14*b* of derrick 14. In the embodiment shown in FIGS. 2A and 2B, heave compensation system 100 generally includes a support structure or frame 102, a crown block 200, a pair of stabilization or rocker arm assemblies 250, a pair of compensator cylinder assemblies 300, an accumulator assembly 400, a plurality of compensation vessel or cylinder assemblies 500, and an active heave compensation assembly 600. In this embodiment, frame 102 comprises a first or longitudinally lower support frame or water table 104, a second or upper support frame or top frame 150, and a longitudinally extending support structure 140 extending longitudinally between and coupling the lower frame 102 and the upper frame 150. Lower support frame 104 is coupled to the longitudinally upper end 14*b* of derrick 14 while upper support frame 150 is disposed at or defines a longitudinally upper end of vessel 11.

Crown block 200 of heave compensation system 100 is disposed within support frame 102 and is permitted to travel or be displaced longitudinally relative support frame 102, derrick 14, and rig floor 12 to compensate for longitudinal movement or heave of vessel 11. Crown block 200 is coupled with travelling block 20 shown in FIG. 1 via drilling cables 24 (not shown in FIGS. 2A, 2B) in a block and tackle arrangement such that travelling block 20 is suspended from crown block 200. In this arrangement, heave compensation provided to crown block 200 via relative longitudinal movement between crown block 200 and support frame 102 is also provided to travelling block 20 and the drill string 18 coupled thereto.

Stabilization assemblies 250 of heave compensation system 100 are each configured to reduce weight-on-bit (e.g., weight on drill bit 26 of FIG. 1) caused by compression and decompression of fluid of heave compensation system 100 as crown block 200 moves longitudinally relative support frame 102. In the embodiment shown in FIGS. 2A, 2B, each stabilization assembly 250 comprises a first rocker arm 252, and a second rocker arm 254 comprising a pair of sheaves 256. Further, in this embodiment stabilization assemblies engage a shared stabilization cable 258 that engages the sheaves 256 of each assembly 250. A first end of the first arm 252 is pivotably coupled to the lower frame 104 of support frame 102 while a second end of first arm 252 is pivotably coupled to second arm 254. Each end of second arm 254 is coupled to a sheave 256, where sheaves 256 are permitted to rotate relative second arm 254. In addition, one end of second arm 254 is pivotably coupled to crown block 200, thereby forming an articulated or pivotable connection between crown block 200 and support frame 102.

The stabilization cable 258 shared by stabilization assemblies 250 may be connected to a drawworks (not shown) at a first end, and fixed at another end to the rig floor 12 of vessel 11 at a second end. Stabilization cable passes around and engages the sheaves 256 of a first stabilization assembly 250, passes between the crown block 200 and the traveling block 20, and passes through the second stabilization assembly 250. In this configuration, stabilization cable 258 may be adjusted as desired to control the movement of the crown block 200 with respect to the traveling block 20 utilizing the pair of stabilization assemblies 250 of the motion compensation system 100. Although in the embodiment shown in FIGS. 2A, 2B heave compensation system 100 comprises the pair of stabilization assemblies 250, in other embodiments system 100 may not include stabilization assemblies 250, and instead, may include other mechanisms for stabilizing the displacement of crown block 200.

As will be discussed further herein, cylinder assemblies 300, accumulator assembly 400, and the plurality of vessel assemblies 500 are configured to provide passive heave compensation functionality to the crown block 200 and the components coupled thereto, such as travelling block 20, drive 22, and drill string 18. In the embodiment shown in FIGS. 2A, 2B, cylinder assemblies 300, accumulator 400, and vessel assemblies 500 are each physically supported by and extend longitudinally from the lower frame 104 of support frame 102. In other embodiments, vessel assemblies 500 may be disposed and physically supported in alternative ways. For instance, in some embodiments vessel assemblies 500 may be supported by support members extending from support structure 140. In still other embodiments, vessel assemblies 500 may be mounted on the rig floor (e.g., rig floor 12 shown in FIG. 1). In the embodiment shown in FIGS. 2A and 2B, each vessel assembly 500 is filled with a pressurized gas or compressible fluid (e.g., air, etc.) and is fluidically coupled with accumulator 400 via a gas valve assembly 460 disposed at a first or longitudinally upper end of accumulator 400. Gas valve assembly 460 comprises one or more actuatable valves and fluid conduits for providing selective fluid communication between vessel assemblies 500 and accumulator 400. In addition, accumulator 400 is fluidically coupled with each cylinder assembly 300 via a liquid valve assembly 470. Particularly, accumulator 400 is at least partially filled with a liquid or incompressible fluid (e.g., water, etc.) with liquid valve assembly 470 comprising one or more actuatable valves and fluid conduits for providing selective fluid communication between liquid disposed in accumulator 400 and each cylinder assembly 300.

Crown block 200 of heave compensation system 100 is physically supported and suspended from each cylinder assembly 300. In the embodiment shown in FIGS. 2A, 2B, each cylinder assembly 300 comprises a cylinder head pendulum 340 pivotably coupled to a first or upper end 320*a* of a piston 320 extending longitudinally from a cylinder 302 in which the piston 320 is reciprocally disposed. In turn, the pendulum 340 of each cylinder assembly 300 is pivotably coupled with a pair of tie rods 342 that extend longitudinally from pendulum 340 to crown block 200. In other words, the tie rods 342 of each cylinder assembly 300 comprise a first or upper end pivotably coupled with pendulum 340 and a second or lower end pivotably coupled with crown block 200. In addition, a longitudinally lower end of the cylinder 302 of each cylinder assembly 300 is releasably coupled to the lower frame 104 of support frame 102, restricting relative longitudinal movement between cylinder 302 and support frame 102. In this arrangement, vertical or longitudinal displacement of the piston 320 of each cylinder assembly 300 respective its corresponding cylinder 302 causes corresponding longitudinal displacement of crown block 200 relative support frame 102.

Active heave compensation assembly 600 of heave compensation system 100 is configured to provide active heave compensation functionality to the crown block 200 and the components coupled thereto, such as travelling block 20, drive 22, and the drill string 18 (each shown in FIG. 1). In the embodiment shown in FIGS. 2A, 2B, active heave compensation assembly 600 generally includes an actuator assembly 602 generally including an outer cylinder or barrel 603 and a retractable piston 610 reciprocally disposed in cylinder 603. Actuator 602 extends longitudinally from the upper frame 150 of support frame 102, and a lower longitudinal end 610*b* of piston 610 pivotably couples to an upper surface of crown block 200 at a hinged connection 200H. In this arrangement, the longitudinal position of crown block 200 may be controlled via the selective displacement of piston 610 of actuator 602 within cylinder 603.

In this embodiment, active heave compensation assembly 600 further includes a plurality of pressure vessels 620 for providing pressurized fluid to cylinder 603 and a controller or motion reference unit (MRU) 630 (shown schematically in FIG. 1) for controlling the actuation of active heave compensation assembly 600. In certain embodiments, MRU 630 comprises one or more sensors for measuring the heave motion of vessel 11 (shown in FIG. 1) for actively compensating against such measured motion via the controlled displacement of piston 610. Although in the embodiment shown in FIGS. 2A, 2B heave compensation system 100 is shown as comprising active heave compensation assembly 600, in other embodiments, heave compensation system 100 may not include active heave compensation assembly 600, and instead, may comprise a passive heave compensation assembly alone.

Figure 3:
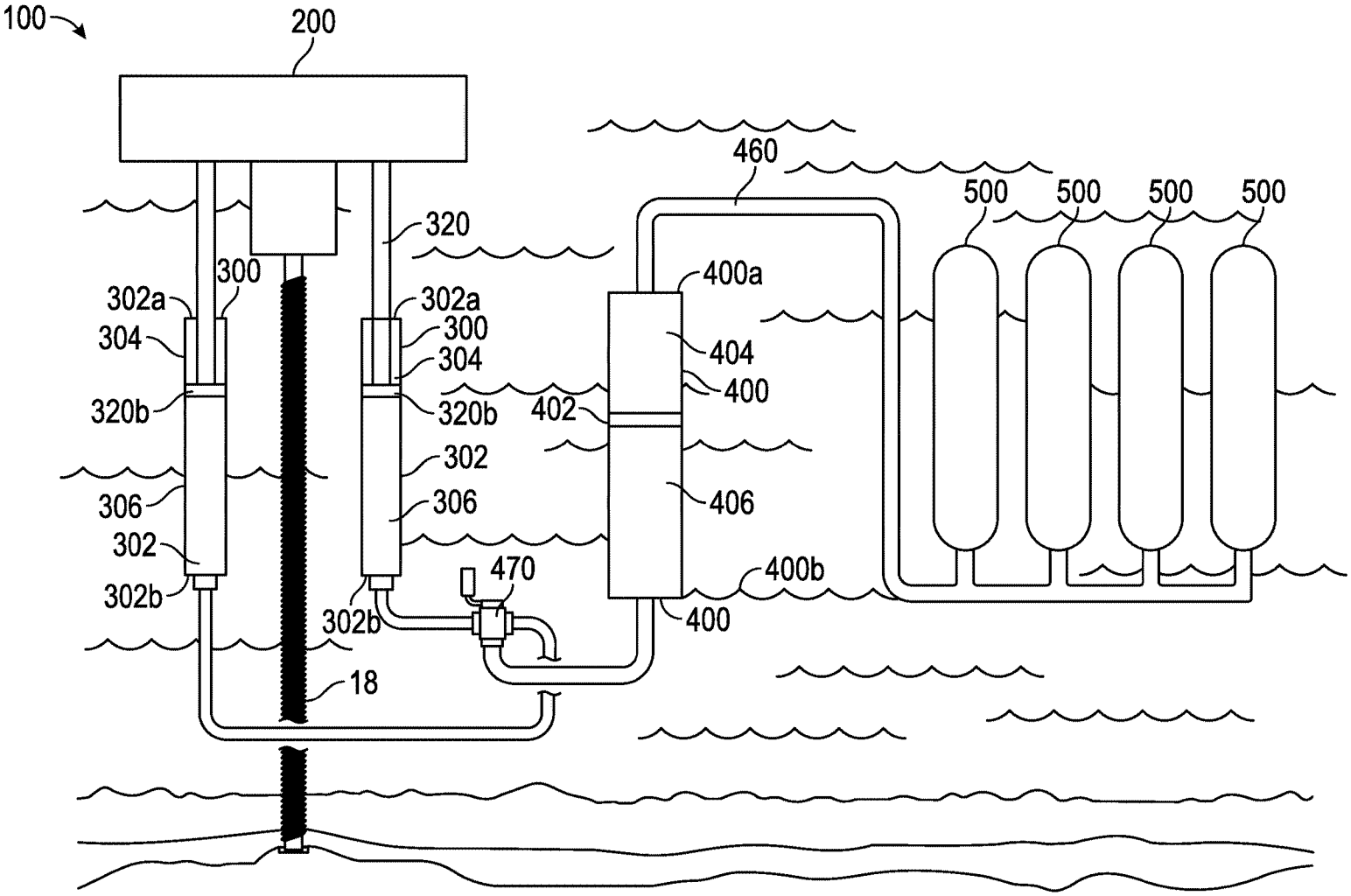
FIG. 3 is a schematic representation of selected components of the heave compensation system of FIG. 2A.

Referring to FIG. 3, a schematic drawing of a portion of the heave compensation system 100 is shown for illustrating at least some of the functionality provided by system 100. As discussed above, in certain embodiments heave compensation system 100 comprises crown block 200, compensator cylinder assemblies 300, accumulator assembly 400, and vessel assemblies 500. In some embodiments, crown block 200 is coupled to the drill string 18, such as by having the crown block 200 coupled to the drill string 18 through the traveling block 20 and the drive 22, as shown in the embodiment illustrated in FIG. 1, and/or may include one or more other connection devices coupled therebetween.

In the arrangement shown in FIG. 3, the piston 320 of each cylinder assembly 300 includes a longitudinally lower end 320*b* disposed within and in sealing engagement with the corresponding cylinder 302, dividing cylinder 302 into a first side or chamber 304 extending between a first or longitudinally upper end 302*a* of cylinder 302 and the lower end 320*b* of piston 320, and a second side or chamber 306 extending between the lower end 320*b* of piston 320 and a longitudinally lower end 302*b* of cylinder 302. In some embodiments, cylinder assemblies 300 comprise plunger-type cylinder assemblies where fluid communication is provided between chambers 304 and 306 of each cylinder 302. In the embodiment shown in FIG. 3, the lower end 302*b* of each cylinder 302 is in fluid communication with accumulator 400 via liquid valve assembly 470. In addition, accumulator 400 includes a first or longitudinally upper end 400*a*, a second or longitudinally lower end 400*b*, and a floating piston 402 disposed within and sealingly engaging an inner surface of accumulator 400. Piston 402 divides accumulator 400 into a first side or chamber 404 extending between upper end 400*a* of accumulator 400 and piston 402, and a second side or chamber 406 extending between piston 402 and the lower end 400*b* of accumulator 400.

In the embodiment shown in FIG. 3, first chamber 404 of accumulator is filled with a compressible fluid, such as a gas, while second chamber 406 is filled with a noncompressible fluid, such as a liquid. In this configuration, liquid valve assembly 470 extends between the lower end 400*b* of accumulator 400 and the lower end 302*b* of each cylinder 302, providing selective fluid communication of a liquid between second chamber 406 of accumulator 400 and the second chamber 306 of each cylinder 302. In addition, gas valve assembly 460 extends between vessel assemblies 500 and the upper end 400*a* of accumulator 400, providing for selective fluid communication of a gas between vessel assemblies 500 and the first chamber 404 of accumulator 400.

In the arrangement described above, movement of crown block 200 in a longitudinally downwards direction (i.e., towards rig floor 12 of vessel 11 shown in FIG. 11) causes pistons 320 to be displaced towards the lower end 302*b* of their respective cylinders 302, decreasing the volume of the second chamber 306 of each cylinder 302. In response to the decrease in volume of second chambers 306, liquid disposed in second chambers 306 is displaced through liquid valve assembly 470 and into the second chamber 406 of accumulator 400. In response to the influx of liquid into the second chamber 406 of accumulator 400, piston 402 of accumulator 400 is displaced towards longitudinally upper end 400*a*, thereby increasing fluid pressure within first chamber 404 by compressing the gas disposed therein. In this manner, the compression of gas disposed in the first chamber 404 of accumulator 400 provides a low frequency damping effect on the longitudinal movement or displacement of crown block 200.

Figure 4A:
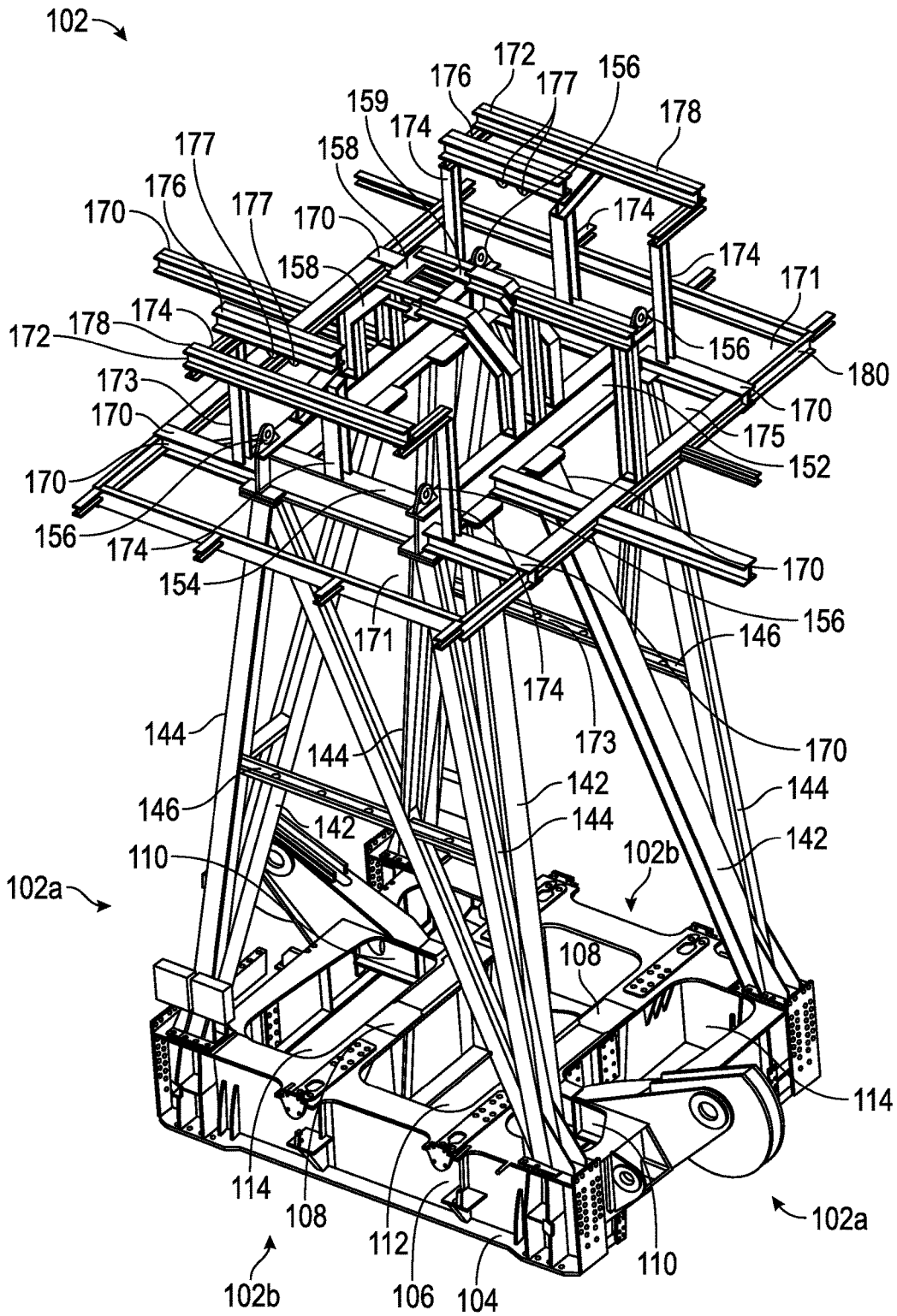
FIG. 4A is a first perspective view of an embodiment of a support frame of the heave compensation system of FIG. 2A in accordance with principles disclosed herein.
Figure 4B:
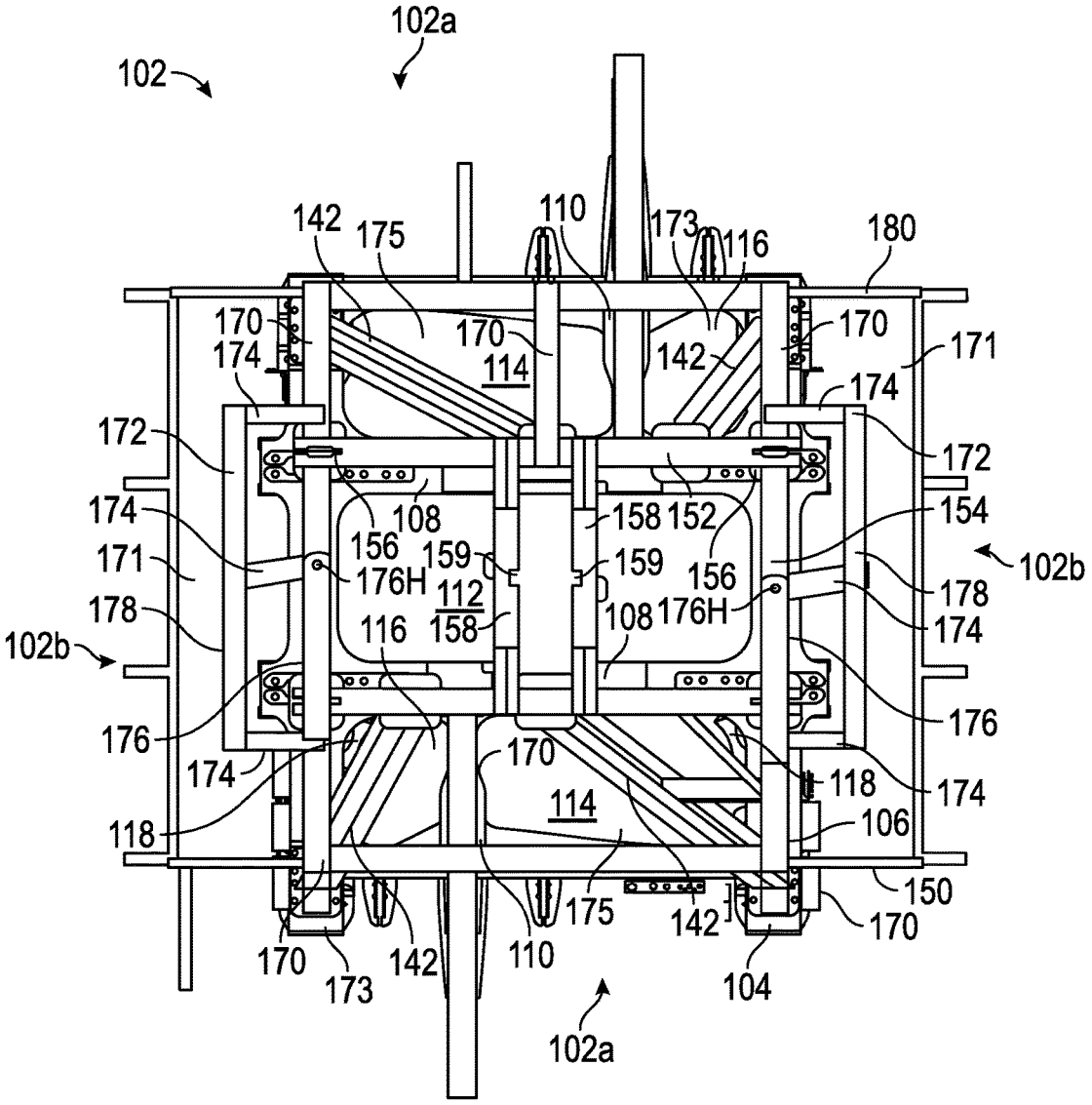
FIG. 4B is a top view of the support frame of FIG. 4A.
Figure 5:
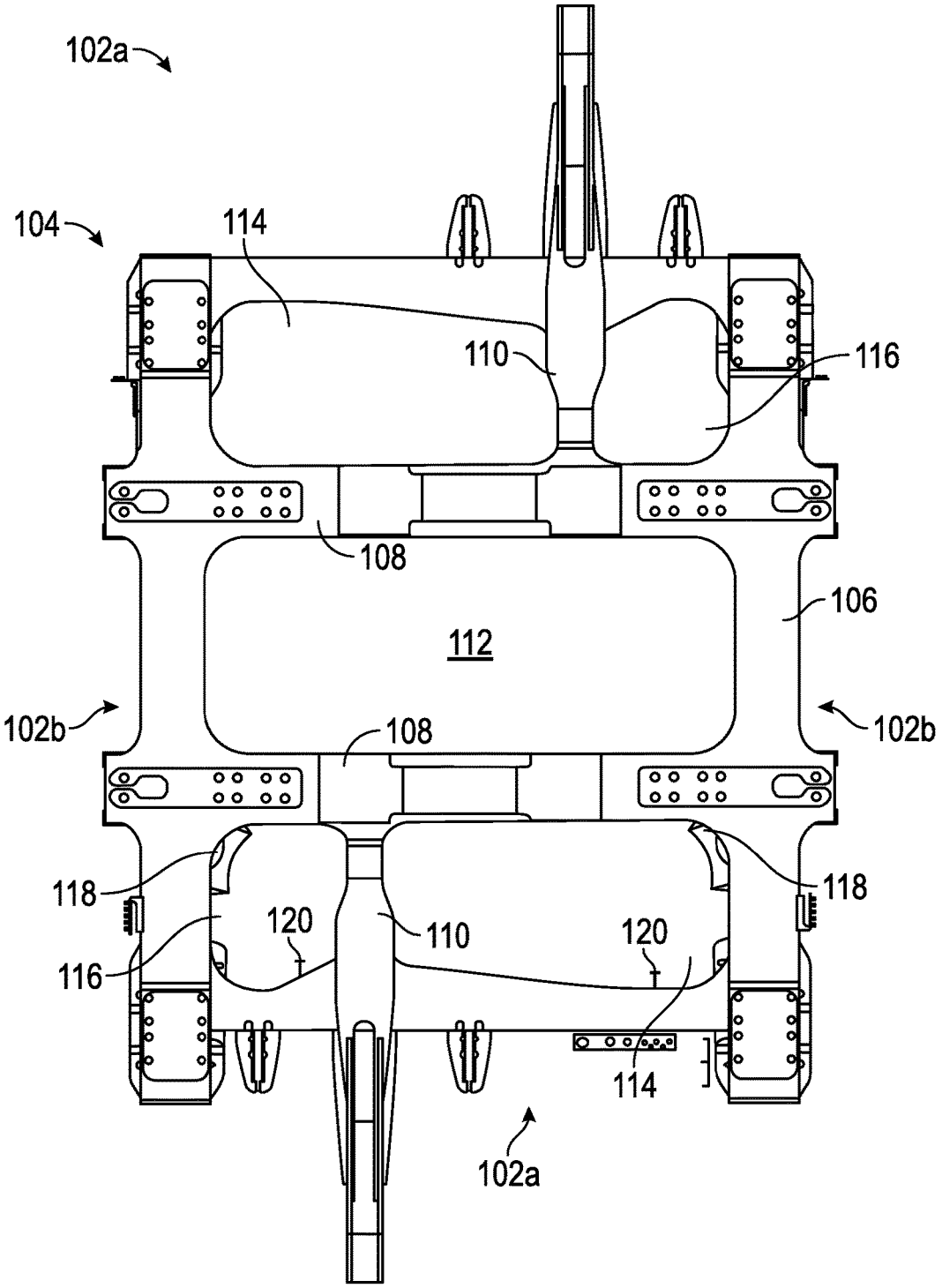
FIG. 5 is a top view of an embodiment of a lower frame of the support frame of FIG. 4A in accordance with principles disclosed herein.

Referring to FIGS. 4A-5, an embodiment of the support frame 102 of heave compensation system 100 is shown. Support frame comprises a first pair of lateral sides 102*a* and a second pair of lateral sides 102*b*, where sides 102*a* and 102*b* each intersect at edges extending therebetween. In this embodiment, lower frame 104 of support frame 102 comprises a rectangular support frame 106 extending along lateral sides 102*a* and 102*b*, and a pair of laterally spaced support members 108 that extend between the second lateral sides 102*b* of rectangular frame 106. In addition, lower frame 104 comprises a pair of sheave support members 110, each supporting a sheave 256 of a stabilization assembly 250. Particularly, each sheave support member 110 extends laterally from a lateral support member 108 to a first side 102*a* of rectangular frame 104.

In this arrangement, a first or central open area 112 extends between the pair of lateral support members 108, a pair of second open areas 114 extend between a lateral side 102*b* of rectangular frame 106 and a sheave support member 110, and a pair of third open areas 116 extend between an opposing lateral side 102*b* of rectangular frame 106 and a sheave support member 110, as shown particularly in FIG. 5. In the embodiment shown in FIGS. 4A-5, one of the second open areas 114 includes a roller 118 that extends diagonally between a lateral side 102*b* of rectangular frame 106 and a lateral support member 108. Similarly, one of the third open areas 116 includes a roller 118 extending diagonally between a lateral side 102*b* of rectangular frame 106 and a lateral support member 108. Additionally, the second open area 114 and the third open area 116 that include a roller 118 also includes a longitudinally extending guide rail 120. In some embodiments, guide rail 120 comprises a guide rail for a dolly of a top drive (e.g., drive 22 shown in FIG. 1) of drilling system 10. In this embodiment, guide rail 120 is positioned to allow the traversal of components of heave compensation system 100 through open areas of lower frame 104. As will be discussed further herein, rollers 118 facilitate the removal and installation of components of heave compensation system 100 from support frame 102, such vessel assemblies 500.

In the embodiment shown in FIGS. 4A and 4B, upper frame 150 of support frame 102 generally includes a first or inner rectangular support frame 152 and a second or outer rectangular support frame 180, where inner rectangular frame 152 is disposed within outer rectangular frame 180. The inner rectangular frame 152 includes an upper surface 154 and a plurality of lifting lugs 156 extending therefrom, where each lifting lug 156 is disposed at a corner of inner rectangular frame 152. Inner rectangular frame 152 also includes a pair of laterally spaced arched or C-shaped members or frames 158 coupled to upper surface 154 and extending between the first sides 102*a* of inner rectangular frame 152. In this embodiment, each C-frame 158 includes a pair of longitudinally spaced slots 159 for allowing the removal of actuator 602, as will be discussed further herein. Additionally, upper frame 150 includes a plurality of laterally spaced support members 170 extending between the first sides 102*a* of inner rectangular frame 152 and the first sides 102*a* of outer rectangular frame 180. The arrangement of rectangular frames 152, 180, and lateral support members 170 forms a plurality of open areas in upper frame 150 of support frame 102. Particularly, a pair of first open areas 171 extend between the second sides 102*b* of inner frame 152 and the second sides 102*b* of outer frame 180; a pair of second open areas 173 extend between a first pair of adjacent lateral support members 170, and a pair of third open areas 175 extend between a second pair of adjacent lateral support members 170.

In the embodiment shown in FIGS. 4A and 4B, upper frame 150 of support frame 102 includes a pair of component transport assemblies 172 configured to facilitate the removal and installation of components of heave compensation system 100 from support frame 102. Particularly, each transport assembly 172 includes a plurality of laterally spaced L-shaped support frames or brackets 174, each comprising a longitudinally extending support member and a laterally extending member coupled to an upper longitudinal end of the longitudinally extending member. In this embodiment, each transport assembly 172 includes three laterally spaced L-frame 174, with a central L-frame 174 extending longitudinally from the upper surface 154 of the inner rectangular frame 154, and the pair of laterally outer L-frames 174 extending longitudinally from a pair of lateral support members 170.

In addition, each transport assembly 172 includes a first or inner laterally extending support beam 176 and a second or outer laterally extending support beam 178. Specifically, the inner support beam 176 of each assembly 172 extends between a laterally outer L-frame 174 to the centrally disposed L-frame 174 of the assembly 172, with inner support beam 176 disposed at the laterally inner end (i.e., the end closest the longitudinal axis 15) of the L-frames 174. In addition, the inner support beam 176 of each assembly 172 is pivotably coupled to the central L-frame 174 at a hinged connection 176H, providing for relative rotation between inner support beam 176 and the L-frame 174. Conversely, the outer support beam 178 of each assembly 172 extends between the pair of laterally outer L-frames 174 of the assembly 172, and is disposed on the laterally outer end of the L-frames 174. Additionally, a longitudinally lower surface of the inner support beam 176 of each transport assembly 172 includes a pair of lifting lugs 177 extending therefrom. In other embodiments, the inner support beam 176 of each transport assembly 172 may include varying numbers of lifting lugs 177.

Support structure 140 of frame 102 extends longitudinally between lower frame 104 and upper frame 150, thereby providing structural support to upper frame 150. In the embodiment shown in FIGS. 4A and 4B, support structure 140 includes a pair of first angled supports 142 extending longitudinally first sides 102*a* of frame 102, and a pair of second angled supports 144 extending longitudinally along second sides 102*b* of frame 102. Additionally, each pair of second angled supports 144 includes a lateral cross-support member 146 extending laterally therebetween to couple together the each pair of second angled supports 144. As will be discussed further herein, the cross-support 146 of each pair of second angled supports 144 is releasably coupled with its corresponding pair of second angled supports 144, allowing cross-support 146 to be removed therefrom.

Referring to FIGS. 6-11, a method of removing the vessel assemblies 500 from heave compensation system 100 of drilling system 10 is shown. For the sake of clarity, some components of heave compensation system 100 are hidden in FIGS. 6-10B. Additionally, also for the sake of clarity, the vessel assemblies 500 shown in 6 and 8-10B are labeled separately as vessel assemblies 500*a*, 500*b*, 500*c*, and 500*d*. During operation of drilling system 10, it may become necessary to remove and/or replace components of heave compensation system 100, such as in the event of a failure or other issue involving one of the components of system 100. In the embodiment shown in FIGS. 6-10B, heave compensation system 100 is configured to facilitate the removal and/or replacement of components of system 100 in-situ. In other words, system 100 is configured to provide for the removal and/or replacement of components of system 100 (including cylinders 300, vessels 500, assembly 600, etc.) while vessel 10 is deployed at sea. In this manner, components of heave compensation system 100 may be replaced without bringing vessel 11 to shore, significantly reducing the costs incurred in replacing components of system 100.

FIGS. 6-11 particularly illustrate, as an example of the functionality provided by heave compensation system 100, the removal of a vessel assembly 500 from the support frame 102 of heave compensation system 100. As shown particularly in FIGS. 7A and 7B, in this embodiment each vessel assembly 500 includes a cylindrical body or cylinder 502 including first or upper longitudinal end 502*a* (shown in FIGS. 7A and 7B), a second or lower longitudinal end 502*b*. Each cylinder assembly 500 additionally includes a fluid coupler 502 disposed at upper end 502*a*, a lower bracket mount 506 disposed at lower end 502*b*, and an upper bracket mount 508 disposed at upper end 502*a*. Fluid coupler 504 of each vessel assembly 500 is configured to provide fluid communication between the vessel 500 and gas valve assembly 460. Lower bracket mount 506 of each vessel 500 releasably couples with a vessel assembly mount 510 (shown in FIG. 6) of the lower frame 104 of support frame 102 to physically support vessels 500. Further, upper bracket assembly 508 is configured to support the upper end 500*a* of each vessel 500 and releasably couple the vessel 500 with upper frame 150 of support frame 102. In this embodiment, the upper bracket assembly 508 of each vessel assembly 500 includes a plurality of apertures 509 disposed therein.

Figure 11:
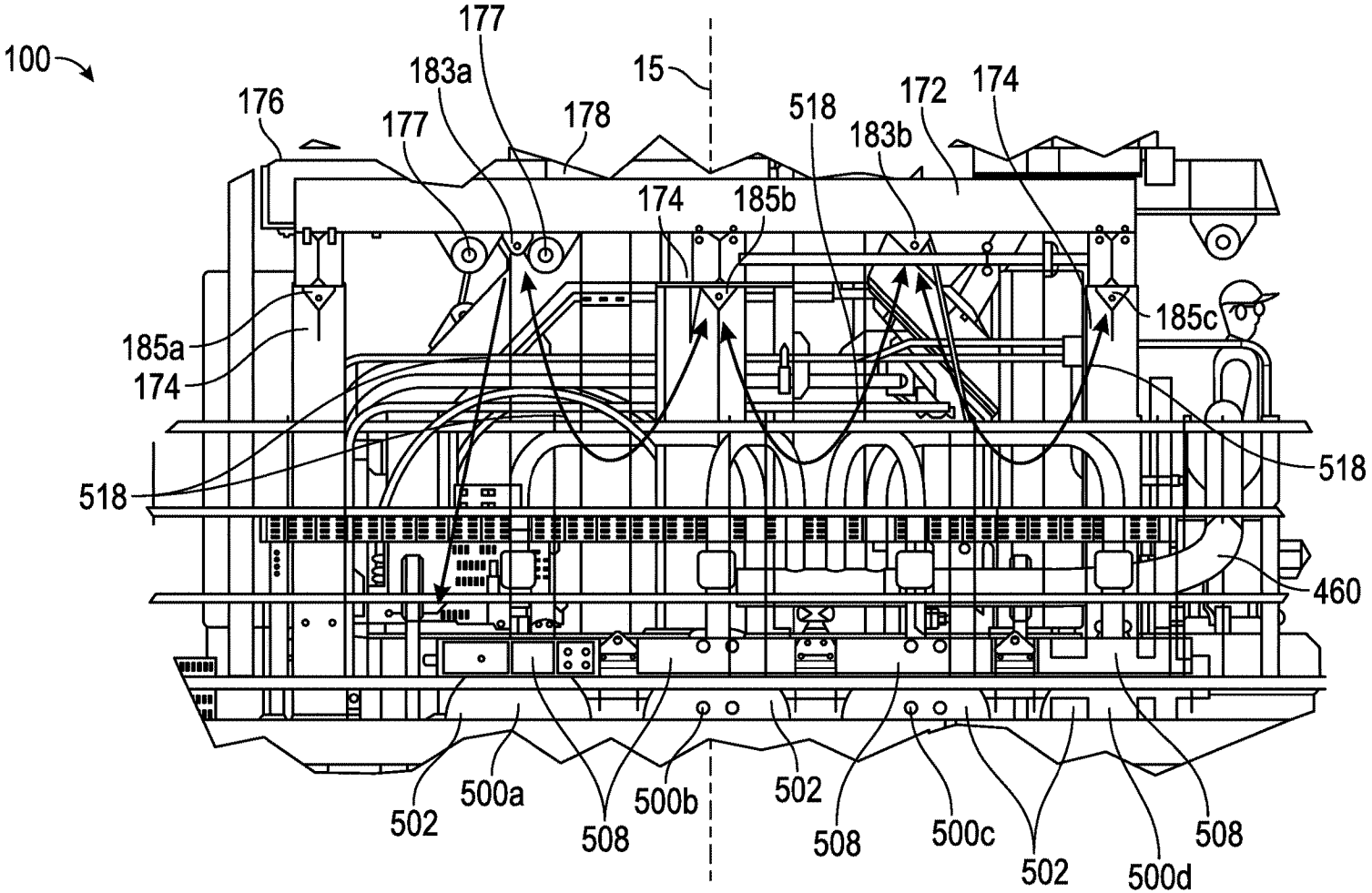
FIG. 11 is a zoomed-in side view of the heave compensation system of FIG. 2A illustrating another step of the method for removing a vessel assembly of the heave compensation system of FIG. 2A.

As shown particularly in FIG. 11, each transport assembly 172 of heave compensation system 100 includes additional lifting lugs or members for providing physical support for components of system 100 as they are installed or uninstalled from system 100 and drilling system 10. In the embodiment shown in FIG. 11, the outer support beam 178 of each transport assembly 172 includes a pair of longitudinally spaced upper lifting lugs 183*a* and 183*b* that extend from a lower surface of the outer support beam 178. In other embodiments, the outer support beam 178 of each transport assembly 172 may include a plurality of lifting lugs disposed at the location of upper lifting lug 183*b*. Additionally, each L-frame 174 of each transport assembly 172 includes at least one upper lifting lug 185 (labeled as 185*a*, 185*b*, and 185*c* in FIG. 11) extending from a lower surface thereof. In this configuration, upper lifting lugs 183*a*, 183*b*, 185*b*, and 185*c* are each positioned such that they substantially align with a longitudinal axis of a corresponding vessel assembly 500. In this manner, upper lifting lugs 183*a*, 183*b*, 185*b*, and 185*c* may be used to lift and lower their corresponding vessel assembly 500 vertically without needing to pivot the upper end of each vessel assembly 500 towards its respective lifting lug.

Figure 6:
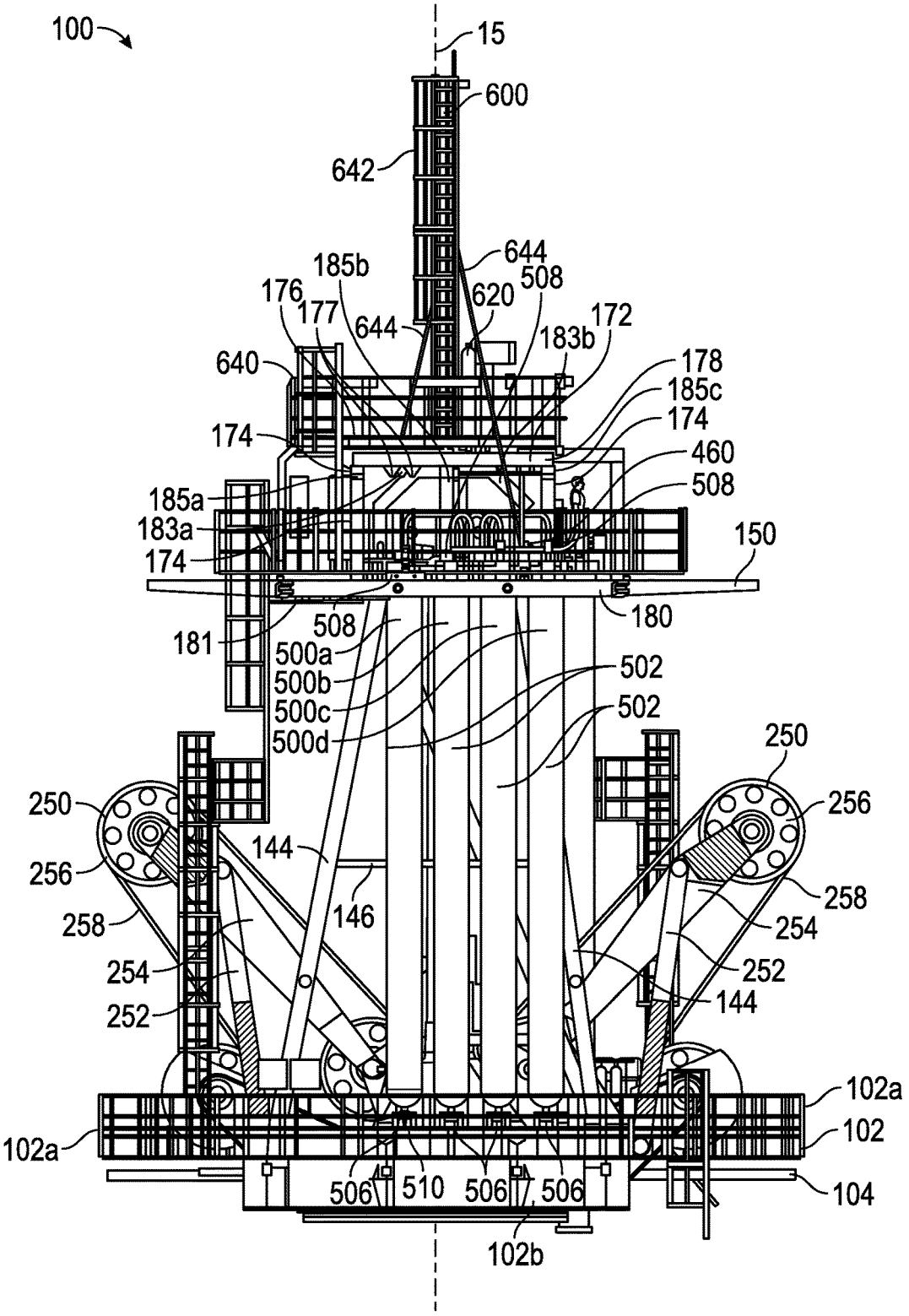
FIG. 6 is a side view of the heave compensation system of FIG. 2A, illustrating a step of an embodiment of a method for removing a vessel assembly of the heave compensation system of FIG. 2A.
Figure 7A:
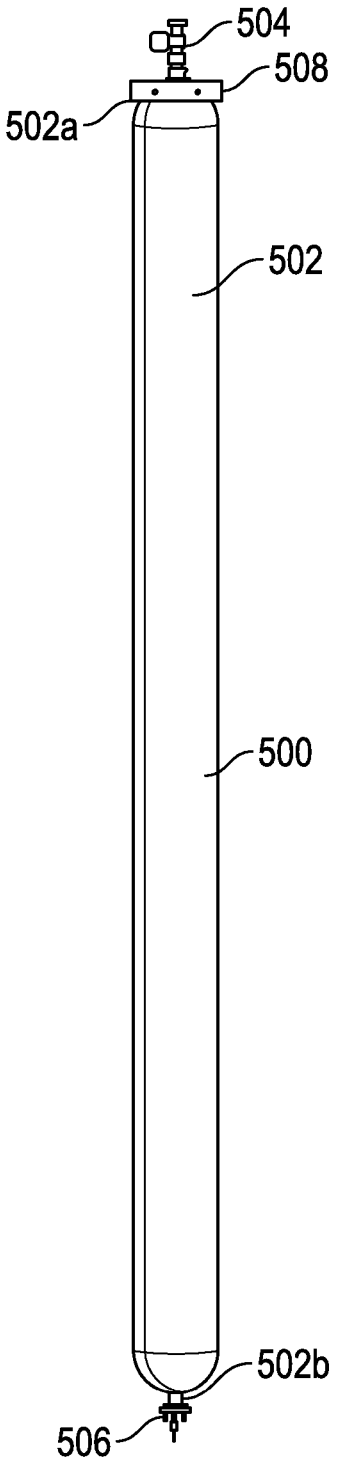
FIG. 7A is a side view of an embodiment of the vessel assembly of FIG. 6.
Figure 7B:
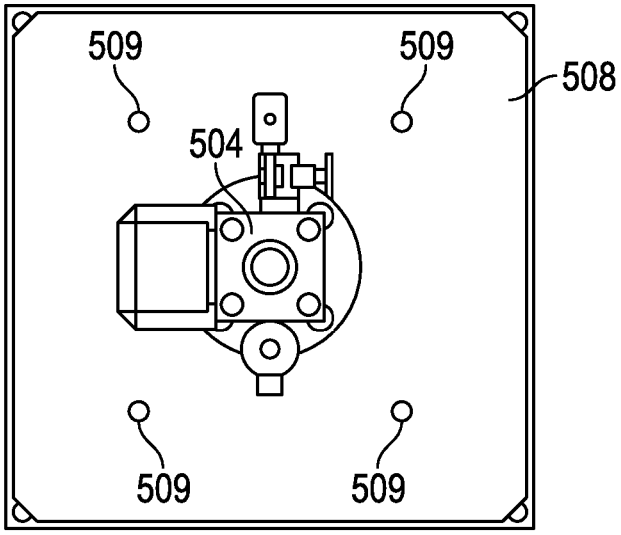
FIG. 7B is a top view of the vessel assembly of FIG. 7A.

As shown particularly in FIG. 6, in this embodiment, prior to removal each vessel assembly 500 of heave compensation system 100 is releasably coupled to the lower frame 104 and upper frame 150 of support frame 102. In the arrangement shown in FIG. 6, vessel 500*a* is disposed proximal the second open area 114 of lower frame 104 that includes roller 118 (shown in FIGS. 9B and 10B), while vessel 500*d* is disposed distal the second open area 114 that includes roller 118. To remove the vessel assembly 500*a* from support frame 102, the fluid coupler of vessel 500*a* is decoupled from gas valve assembly 460 and the lower bracket 506 is decoupled from the mount 510 of lower frame 104. In certain embodiments, the lower bracket 506 of each vessel assembly 500 (shown as assemblies 500*a*-500*d* in FIG. 6) is decoupled from mount 510. In this embodiment, mount 510 of lower frame 104 may additionally be disassembled. Further, the cross-support 146 of the pair of second angled supports 144 disposed proximal vessel assemblies 500*a*-500*d* is removed from support structure 140 to provide additional space for manipulating vessel assembly 500*a*.

Figure 8:
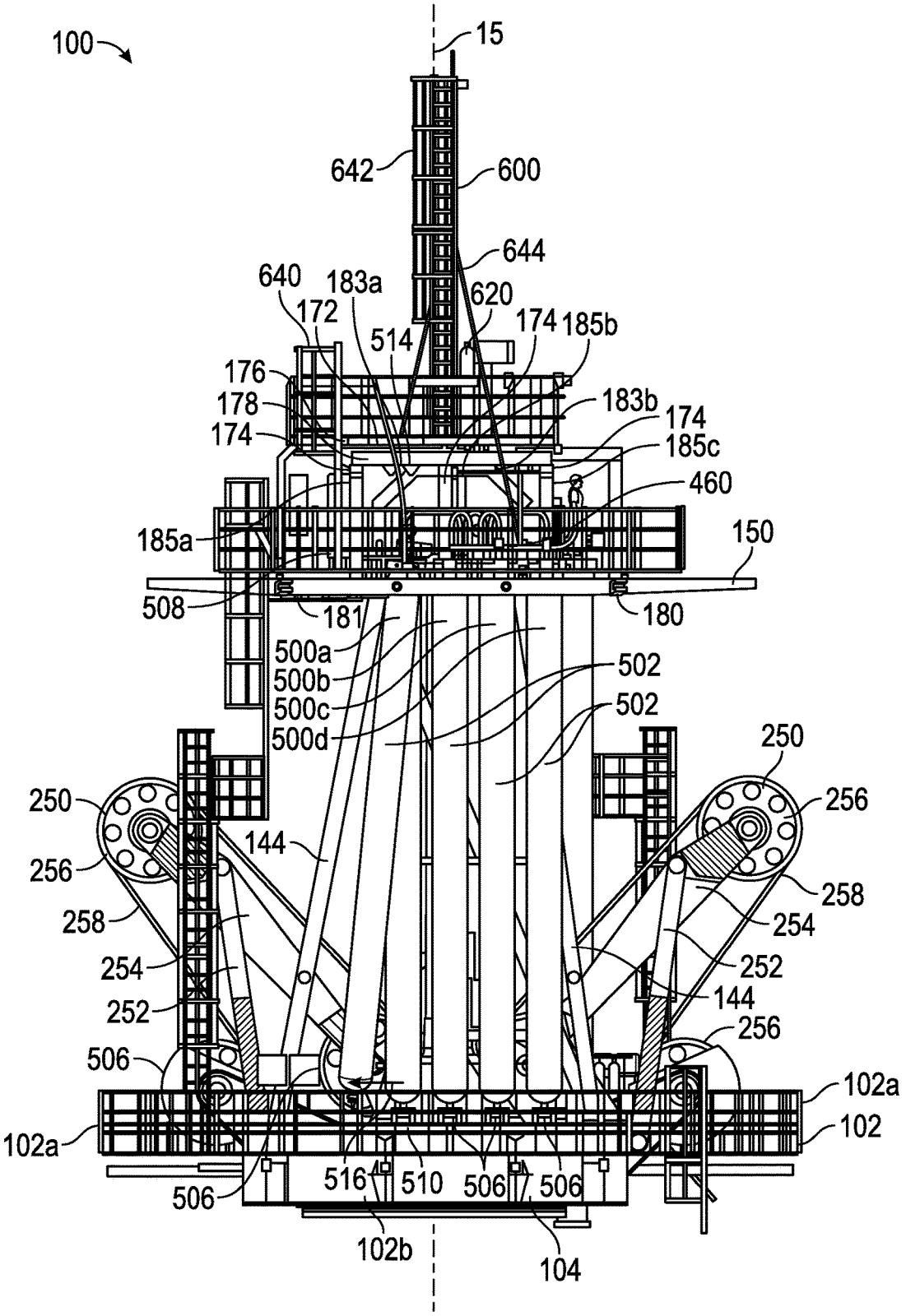
FIG. 8 is a side view of the heave compensation system of FIG. 2A illustrating another step of the method for removing a vessel assembly of the heave compensation system of FIG. 2A.
Figure 9A:
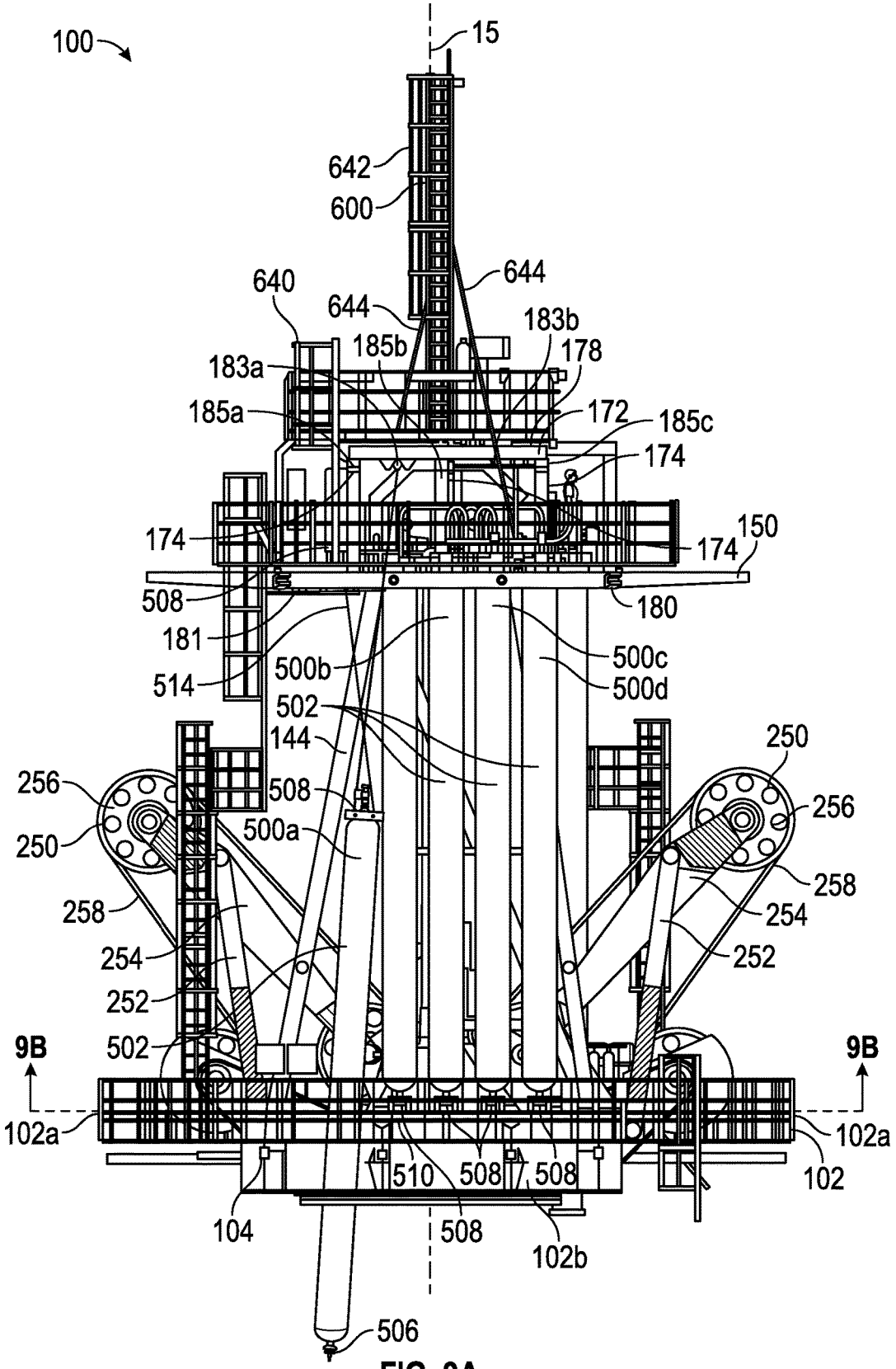
FIG. 9A is a side view of the heave compensation system of FIG. 2A illustrating another step of the method for removing a vessel assembly of the heave compensation system of FIG. 2A.
Figure 9B:
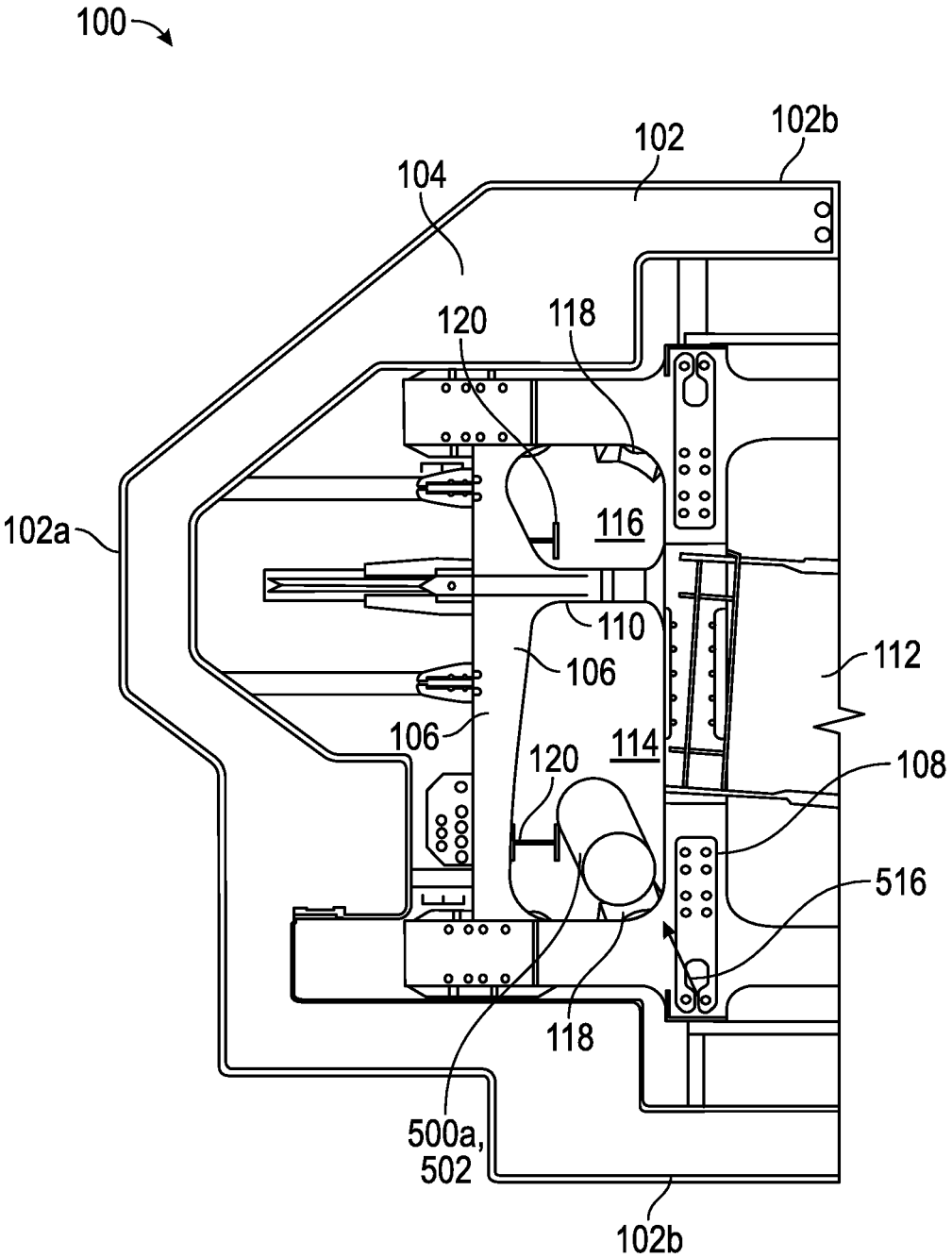
FIG. 9B is a top view of the heave compensation system of FIG. 2A illustrating the step of FIG. 9A of the method for removing a vessel assembly of the heave compensation system of FIG. 2A.

As shown particularly in FIG. 8, following the decoupling of vessel assembly 500*a* from gas valve assembly 460 and the decoupling of vessel 500*a* from mount 510, vessel assembly 500*a* may be coupled to either upper lifting lug 183*a* (as shown in FIG. 8) or one of the upper lifting lugs 185 disposed proximal vessel assemblies 500*a*-500*d* via a chain hoist or cable 514 releasably coupled to upper bracket 508 via holes 509. In this configuration, upper lifting lug 183*a* is disposed near the longitudinal end of support beam 178 proximal vessel assembly 500*a*. With vessel 500*a* coupled to upper lifting lug 183*a*, the weight of vessel 500*a* may be supported by outer support beam 178 and the L-supports 174 of the transport assembly 172 disposed proximal vessel assemblies 500*a*-500*d*. In this position, the upper mount 506 of vessel assembly 500*a* is decoupled or released from the upper frame 104, allowing vessel assembly 500*a* to move or be displaced relative support frame 102.

With vessel assembly 500*a* hanging from the hoist 514 coupled to upper lifting lug 183*a*, the lower end 502 of the cylinder 502 of vessel assembly 500*a* is pivoted towards the second open area 114 that includes roller 118, as indicated by arrow 516 in FIG. 8. In some embodiments, soft slings or other tools or mechanisms are used to pivot or rotate the lower end 502*b* of the cylinder 502 of vessel assembly 500*a*. As shown particularly in FIGS. 9A and 9B, once the lower end 502*b* of vessel assembly 500*a* has been pivoted in the direction of second open area 114, vessel assembly 500*a* is lowered a first longitudinal distance towards lower frame 104 and second open area 114. Additionally, as vessel assembly 500*a* is lowered from upper frame 150, the cylinder 502 of vessel 500 is physically engaged and guided by roller 118 of lower frame 104. Following the lowering of vessel assembly 500*a* by the first longitudinal distance, the hoist 514 is coupled to a lower lifting lug 181 disposed directly beneath upper frame 150, where lower lug 181 is positioned over the second open area 114 that includes roller 118.

Figure 10A:
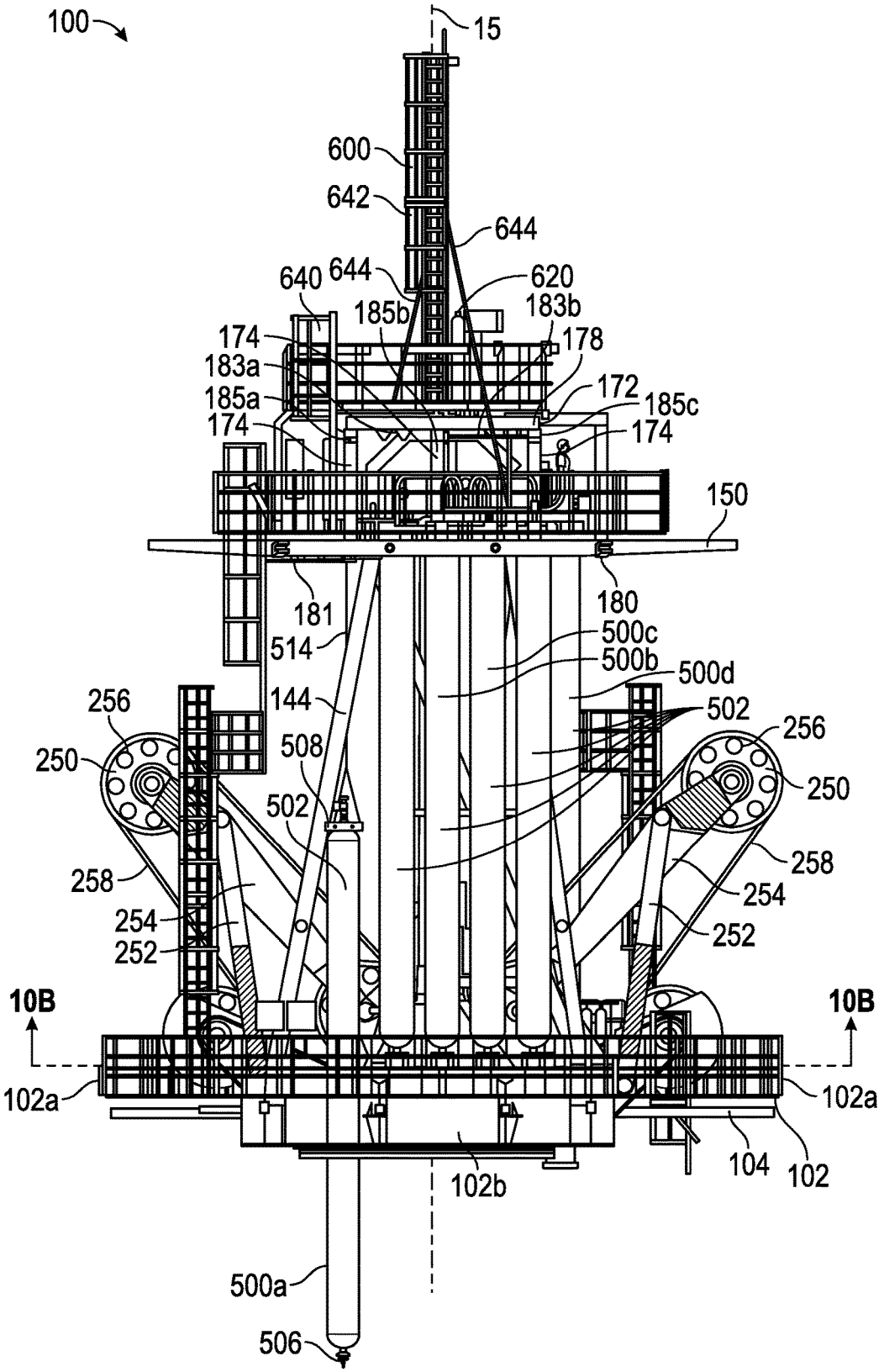
FIG. 10A is a side view of the heave compensation system of FIG. 2A illustrating another step of the method for removing a vessel assembly of the heave compensation system of FIG. 2A.
Figure 10B:
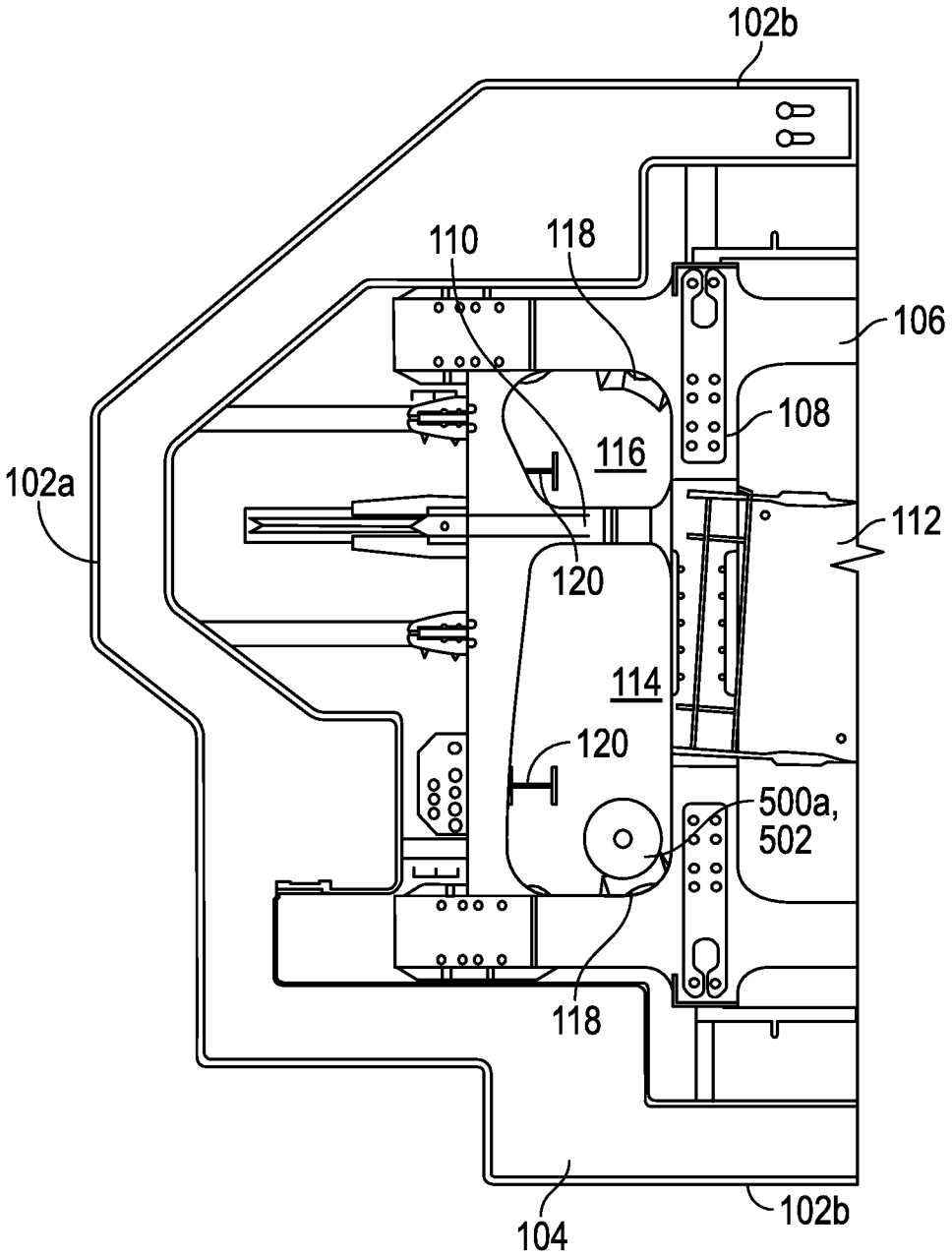
FIG. 10B is a top view of the heave compensation system of FIG. 2A illustrating the step of FIG. 10A of the method for removing a vessel assembly of the heave compensation system of FIG. 2A.

Once hoist 514 is coupled to lower lifting lug 181, the weight of vessel assembly 500*a* is transferred from upper lifting lug 183*a* of outer support beam 178 to lower lifting lug 181, thereby allowing the remaining end of hoist 514 coupled to upper lifting lug 183*a* to be disconnected therefrom and coupled with lower lifting lug 181, as shown particularly in FIGS. 10A and 10B. As the hoist 514 is transferred from upper lifting lug 183*a* to lower lifting lug 181, vessel assembly 500*a* is displaced longitudinally until it is substantially aligned with the second open area 114 of the lower frame 104 that includes rollers 118. In this position, vessel assembly 500*a* is further lowered longitudinally downwards through second open area 114 of lower frame 104 until vessel assembly 500*a* is disposed at the rig floor 12 of vessel 11 (shown in FIG. 1), where vessel assembly 500*a* may be stored or refurbished for future installation in heave support system 100. Particularly, to reinstall vessel assembly 500*a* in system 100, the method described above is performed in substantially reverse order, with vessel 500 raised via lower lug 181 and hoist 514, transferred to upper lifting lug 183*a* and then recoupled with mount 510 and gas valve assembly 460.

Once vessel assembly 500*a* has been removed from heave compensation system 100 as described above, remaining vessel assemblies 500*b*-500*d* may be displaced in the direction of position previously occupied by assembly 500*a* utilizing upper lifting lugs 183*a*, 183*b*, 185*b*, and 185*c*, indicated generally by arrow 518 in FIG. 11. For instance, upper lifting lugs 185*b* and 183*a* may be utilized for manipulating cylinder assembly 500*b*, and upper lifting lugs 183*b*, 185*b*, and 183*a* may be utilized for manipulating cylinder assembly 500*c*. Thus, following the removal of vessel assembly 500*a*, vessel 500*b* may be shifted into the position previously occupied by vessel 500*a*, vessel 500*c* may be shifted to the position previously occupied by vessel 500*b*, and vessel 500*d* may be shifted to the position previously occupied by vessel 500*c*. Following this procedure, vessel assembly 500*b* may be lowered to the rig floor 12 in a manner similar to the method described above with respect to vessel assembly 500*a*.

Referring to FIGS. 12A-15B, a method for removing cylinder assemblies 300 from heave compensation system 100 is shown. Particularly, the method illustrated in FIGS. 12A-15B provides for the removal and/or installation of cylinder assemblies 300 from heave compensation system 100 in-situ, such that vessel 11 does not need to be brought to shore in order to replace cylinder assemblies 300. For the sake of clarity, some components of heave compensation system 100 are hidden in FIGS. 12A-15B. In this embodiment, each cylinder assembly 300 includes a guide rail 310 extending along the longitudinal length of the cylinder 302 of each cylinder assembly 300, where guide rail 310 is configured to guide or direct the longitudinal displacement of cylinder assemblies 300 during their removal, as will be discussed further herein. Additionally, each cylinder assembly 300 includes a support member or pedestal 312 releasably coupled to the lower end 302*b* of the cylinder 302. Each pedestal 312 is in turn releasably coupled with the lower frame 104 of support frame 102 to couple each cylinder assembly 300 to support frame 102. Particularly, each pedestal 312 is positioned such that it extends laterally across the central open area 112 (shown particularly in FIG. 4A) of lower frame 104 such that each lateral end is supported on and releasably coupled with a lateral support member 108. Guide rails 310 extend longitudinally past the lower end 302*b* of cylinders 302 and along pedestals 312, and thus, are greater in longitudinal length than cylinders 302.

Figure 12A:
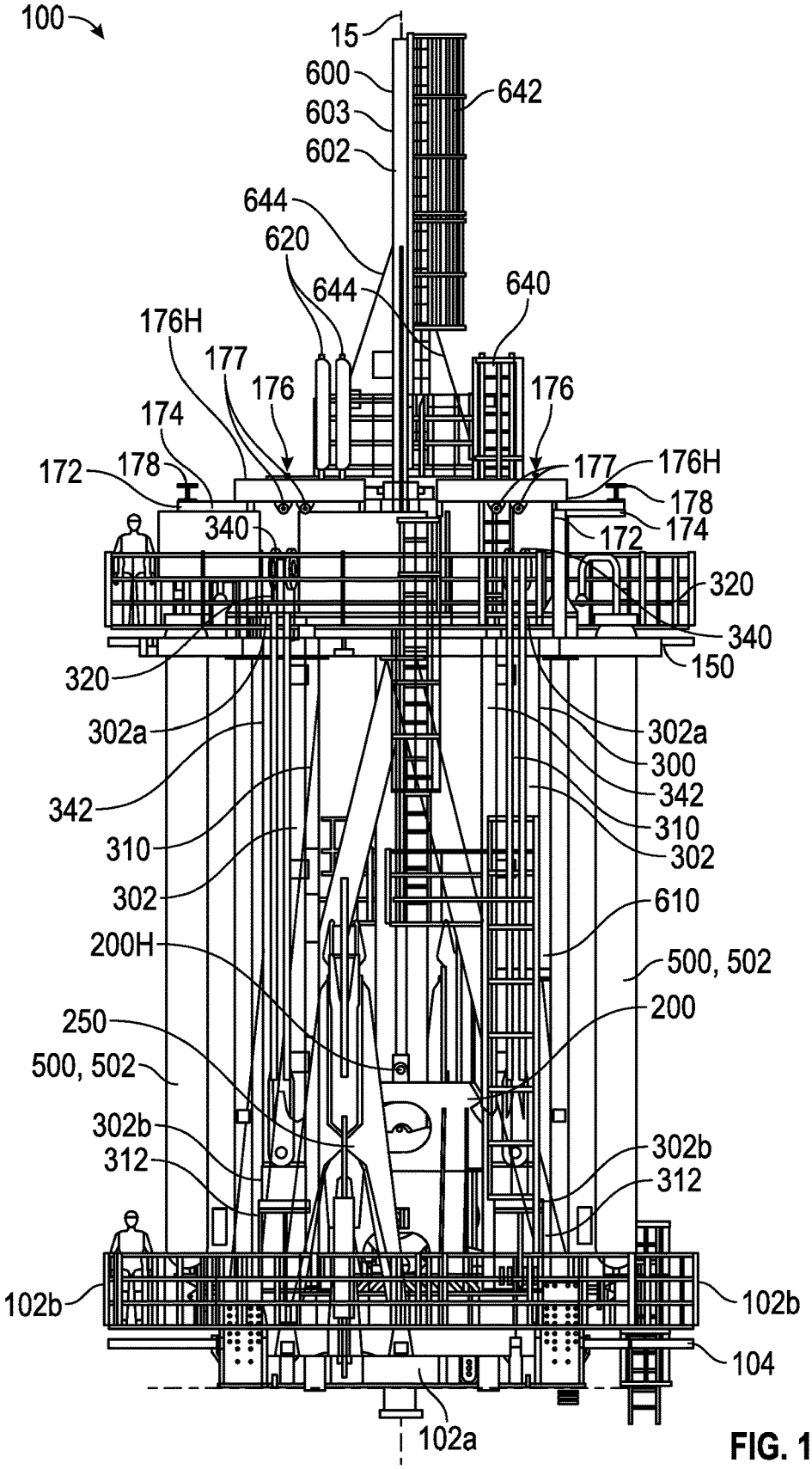
FIG. 12A is a front view of the heave compensation system of FIG. 2A illustrating a step of an embodiment of a method for removing a cylinder assembly of the heave compensation system of FIG. 2A.
Figure 12B:
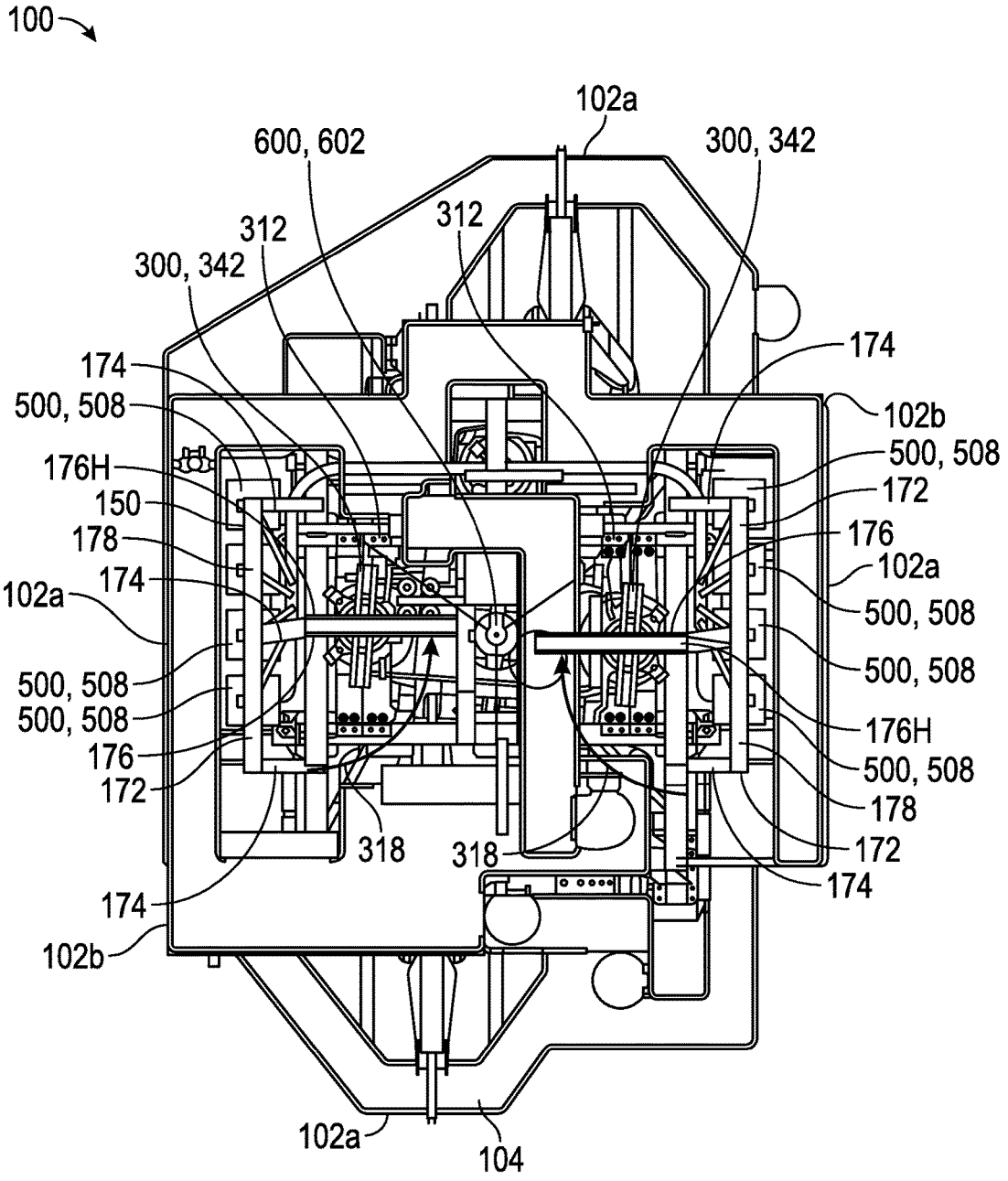
FIG. 12B is a top view of the heave compensation system of FIG. 2A illustrating the step of FIG. 12A of the method for removing a cylinder assembly of the heave compensation system of FIG. 2A.
Figure 13:
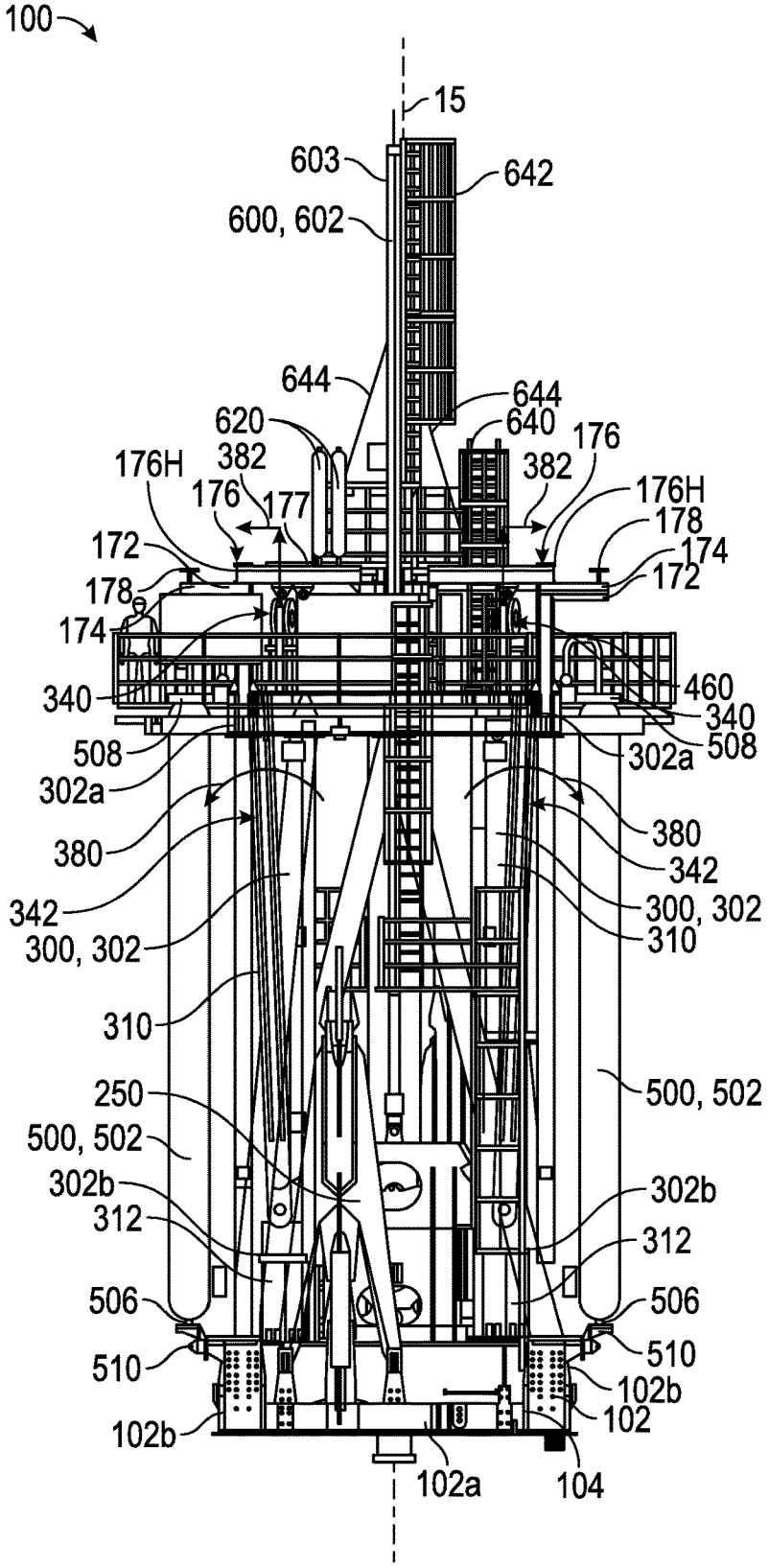
FIG. 13 is a front view of the heave compensation system of FIG. 2A illustrating another step of the method for removing a cylinder assembly of the heave compensation system of FIG. 2A.

As shown particularly in FIGS. 12A and 12B, to remove cylinder assemblies 300 from heave compensation system 100, the inner support beam 176 of each transport assembly 172 is rotated about its respective hinged connection 176H until it aligns with or intersects the longitudinal axis of a corresponding cylinder assembly 300 of system 100 (indicated by arrows 318 in FIG. 12B). In this position, the lifting lugs 177 of each inner support beam 176 are disposed longitudinally above a corresponding cylinder assembly 300. Following the rotation of the inner beam 176 of each transport assembly 172 shown in FIGS. 12A and 12B, the tie rods 342 of each cylinder assembly 300 are decoupled from their respective pendulum 340 and pivoted laterally about their lower ends towards a support surface of upper frame 150 (indicated generally by arrows 380 in FIG. 13) for securement thereto. In certain embodiments, decoupling tie rods 342 from their respective pendulum 340 comprises removing each pendulum 340 from the upper end 320*a* of the piston 320 its respective cylinder assembly 300, as shown generally by arrows 382 in FIG. 13. In some embodiments, this process comprises disassembling pins releasably coupling tie rods 342 with pendulum 340 and pendulum 340 with the upper end 320*a* of piston 320. In some embodiments, a chain hoist or other mechanism supported by lifting lugs 177 may be used to support pendulum 340 and tie rods 342 during their removal and/or decoupling.

Figure 14:
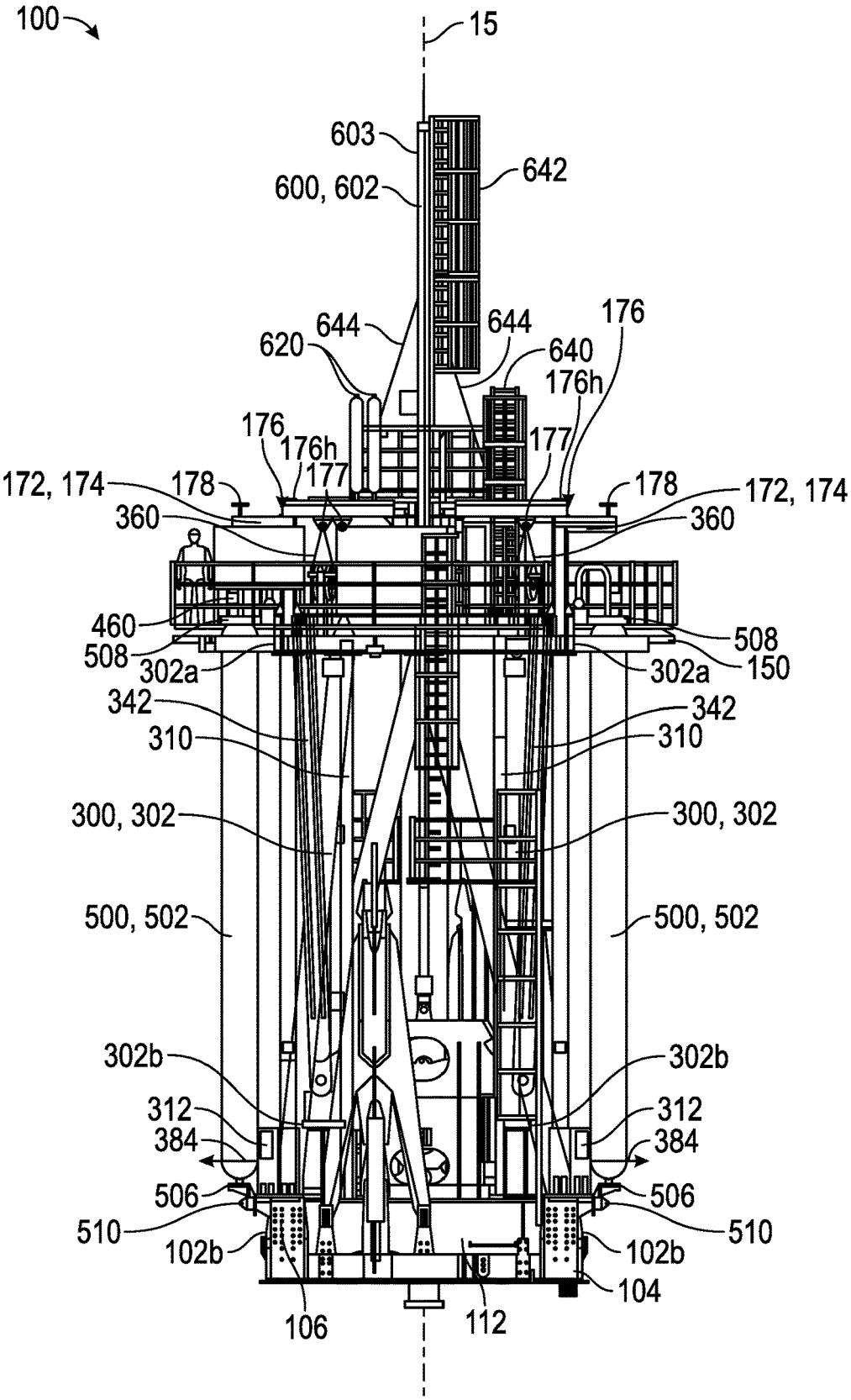
FIG. 14 is a front view of the heave compensation system of FIG. 2A illustrating another step of the method for removing a cylinder assembly of the heave compensation system of FIG. 2A.

Once the upper end of each tie rod 342 has been decoupled from its respective pendulum 340, and the pendulum 340 has been removed from its corresponding cylinder assembly 300, a chain hoist or cable 360 is coupled between the longitudinal upper end 302*a* of each cylinder 302 and the lifting lug 177 of a corresponding inner support beam 176, as shown in FIG. 14. In this arrangement, the weight of each cylinder assembly 300 is supported by the upper frame 150 via the corresponding inner support beam 176 and L-frame 174 coupled therewith. In this configuration, pedestals 312 are no longer required to support the weight of cylinder assemblies 300. Thus, following the coupling of each hoist 360 to its respective cylinder assembly 300, each pedestal 312 is removed from heave compensation system 100 via decoupling the pedestal 312 from the lower end 302*b* of its respective cylinder 302 and from the lower frame 104 of support frame 102, as indicated generally by arrow 384 in FIG. 14. In this embodiment, pedestals 312 are removed by displacing them laterally until they are disposed directly adjacent a second side 102*b* of lower frame 104. In this position, each pedestal 312 no longer extends across central open area 112 of lower frame 104, providing space or access for the displacement of cylinders 302 therethrough.

In some embodiments, decoupling pedestals 312 from cylinders 302 and lower frame 104 comprises unbolting (e.g., removing threaded fasteners) pedestals 312 from both the lower end 302*b* of its corresponding cylinder 302 and from the lower frame 104 of support frame 102. In some embodiments, pedestals 312 may be laterally displaced (as indicated by arrows 384) from cylinder assemblies 300 using a chain block, hydraulic tool, or other such mechanism or tool. In some embodiments, this process further comprises disassembling piston lugs disposed at the upper end 302*a* of each cylinder 302.

Figure 15A:
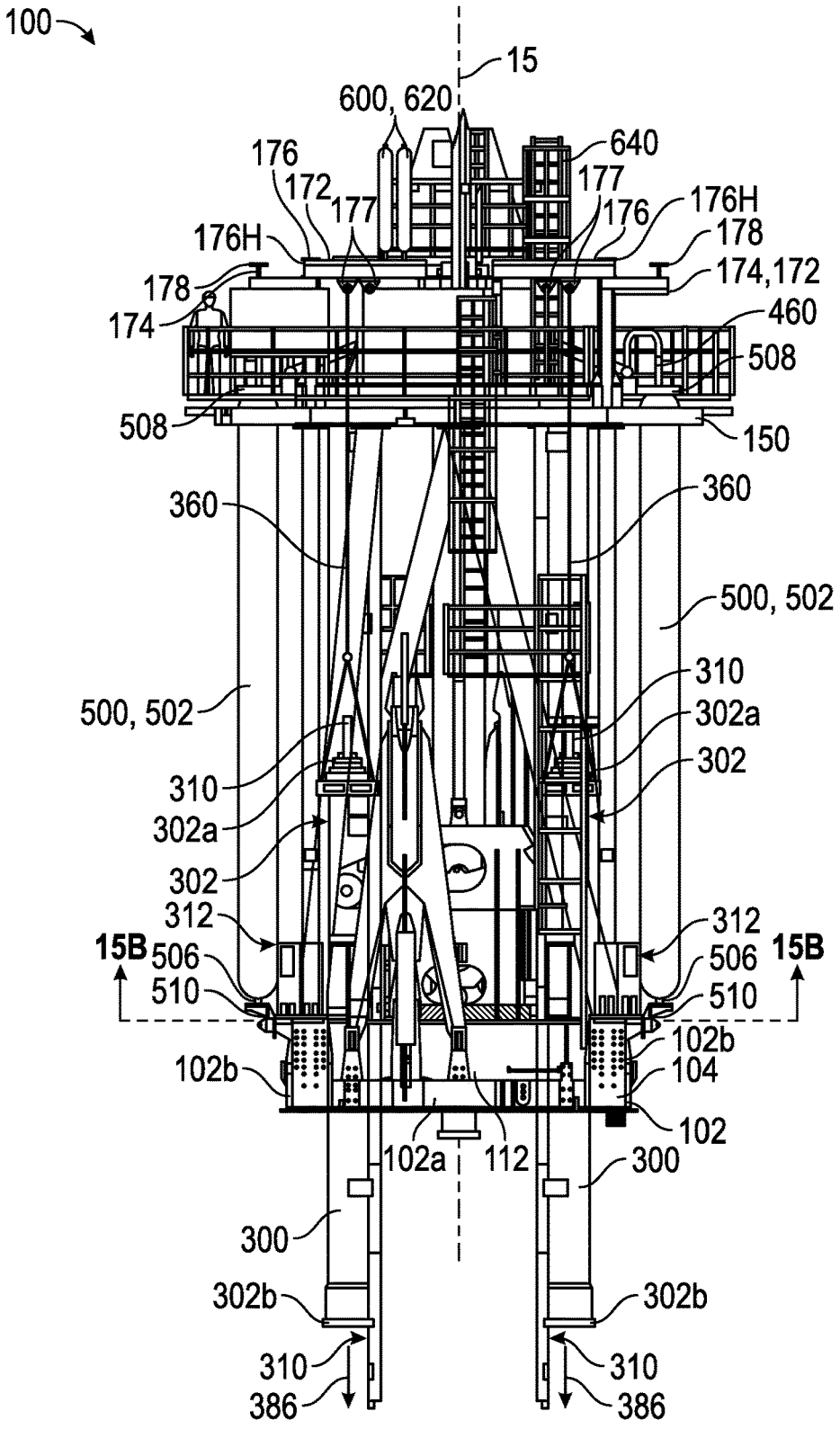
FIG. 15A is a front view of the heave compensation system of FIG. 2A illustrating another step of the method for removing a cylinder assembly of the heave compensation system of FIG. 2A.
Figure 15B:
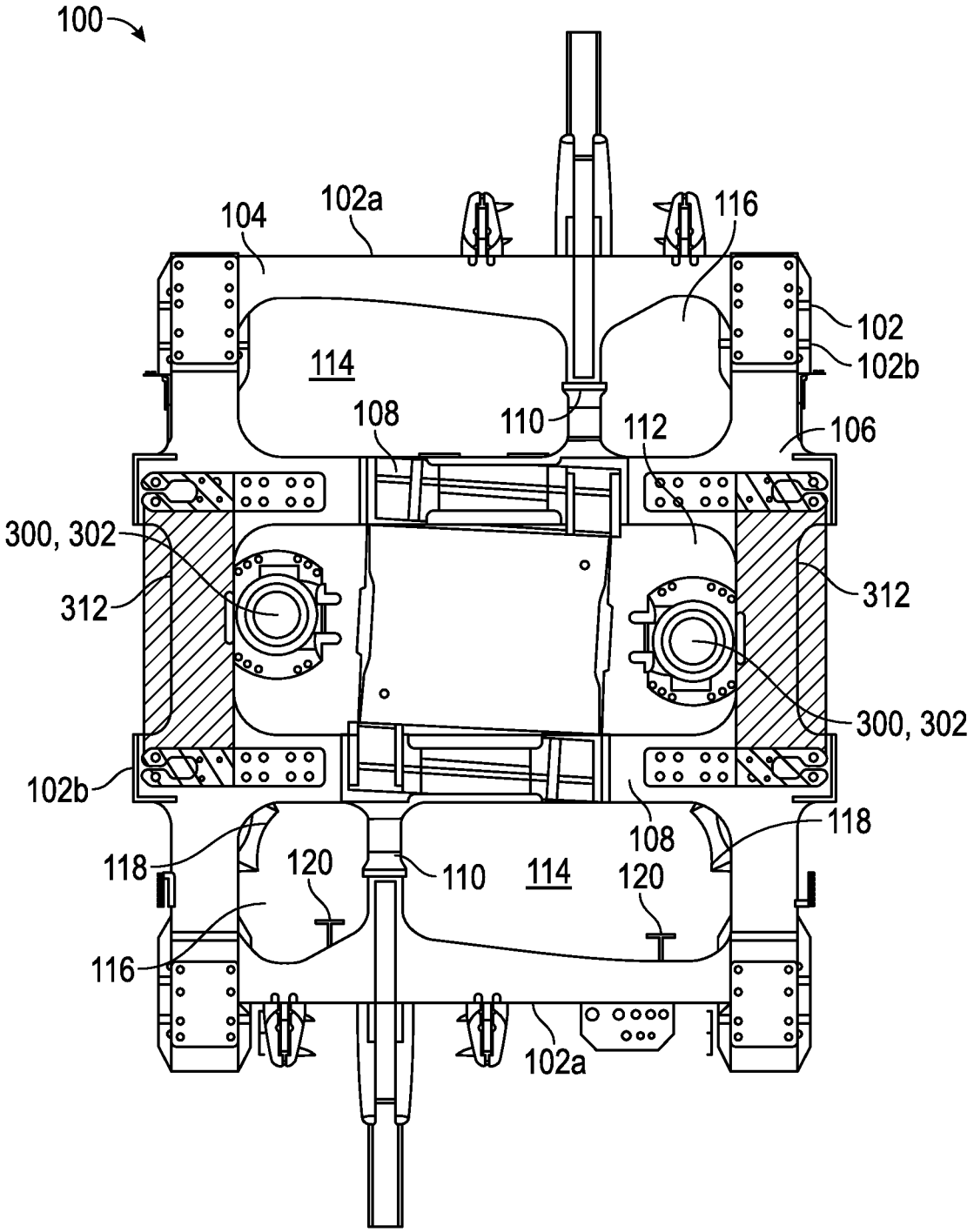
FIG. 15B is a top view of the heave compensation system of FIG. 2A illustrating the step of FIG. 15A of the method for removing a cylinder assembly of the heave compensation system of FIG. 2A.

Following the decoupling and subsequent displacement of pedestals 312 to the second sides 102*b* of lower frame 104, each cylinder 302 (including its respective piston 320) is lowered through the vacated central open area 112 of lower frame 104 via hoists 360 suspended from the lifting lugs 177 of inner support beams 176, as indicated by arrows 386 of FIG. 15A and shown in FIGS. 15A and 15B. As cylinders 302 are lowered through lower frame 104, guide rails 310 are used to guide and prevent damage from occurring to their respective cylinder 302 through the central open area 112 of lower frame 104. Once cylinders 302 are displaced below the lower fame 104 of support frame 102, they are further lowered vertically until they reach the rig floor 12 of vessel 11. Cylinders 302 may then be refurbished or replacement cylinders 302 (including pistons 320) may be displaced to support frame 102 for coupling with heave compensation system 100. In this process, the new cylinders 302 may be displaced and assembled with heave compensation system 100 in a procedure similar to, but reversed from, the method described above for decoupling and removing cylinders 302 and their respective pistons 320 from heave compensation system 100. This process may be accomplished in-situ without displacing vessel 11 to the shore.

Thus, an embodiment of a method for removing a component of a heave compensation system (e.g., system 100) comprises decoupling a cylinder assembly (e.g., cylinder assembly 300) from a crown block (e.g., crown block 200), the cylinder assembly configured to displace the crown block in response to a heave motion of a drilling vessel (e.g., vessel 11) supporting the heave compensation system, coupling the cylinder assembly to a support structure (e.g., support frame 102) via a cable (e.g., cable 360); and using the cable to lower the cylinder assembly through an internal volume (e.g., internal volume 16) of a derrick (e.g., derrick 14) of the drilling vessel to a rig floor (e.g., rig floor 12) of the drilling vessel.

Referring to FIGS. 16-25, a method for removing active heave compensation assembly 600 from heave compensation system 100 is shown. Particularly, the method illustrated in FIGS. 16-25 provides for the removal and/or installation of actuator 602 from heave compensation system 100 in-situ such that vessel 11 does not need to be brought to shore in order to replace actuator 602. For the sake of clarity, some components of heave compensation system 100 are hidden in FIGS. 16-25. In the embodiment shown in FIGS. 16-25, active heave compensation assembly 600 includes a support structure 640 extending longitudinally from the upper frame 150 of support frame 102, where support structure 640 includes a plurality of ladders 642 for providing access to actuator 602 of assembly 600. In this embodiment, ladders 642 are mounted to actuator 602 via a plurality of longitudinally spaced brackets 614 disposed on an outer surface of actuator 602. Additionally, assembly 600 includes a plurality of support cables 644 coupled between cylinder 603 of actuator assembly 602 and the upper frame 150 for securing actuator 602 into a substantially longitudinal position with actuator 602 extending along longitudinal axis 15. Further, cylinder 603 of actuator 602 includes a first or longitudinally upper end 603*a*, a second or longitudinally lower end 603*b*, and a radially outwards extending collar 604 disposed at lower end 603*b*. Cylinder 603 is releasably coupled to active heave compensation actuator support beams or C-frames 158 of upper frame 150 via collar 604 and a plurality of releasably coupled brackets 606 (shown particularly in FIG. 18B). In this arrangement, brackets 606 are releasably coupled to both C-frames 158 and the collar 604 of cylinder 603, thereby releasably coupling collar 604 and cylinder 603 of actuator 602 to C-frames 158 and upper frame 150 of support frame 102, restricting relative longitudinal movement between cylinder 602 and upper frame 150.

Figure 16:
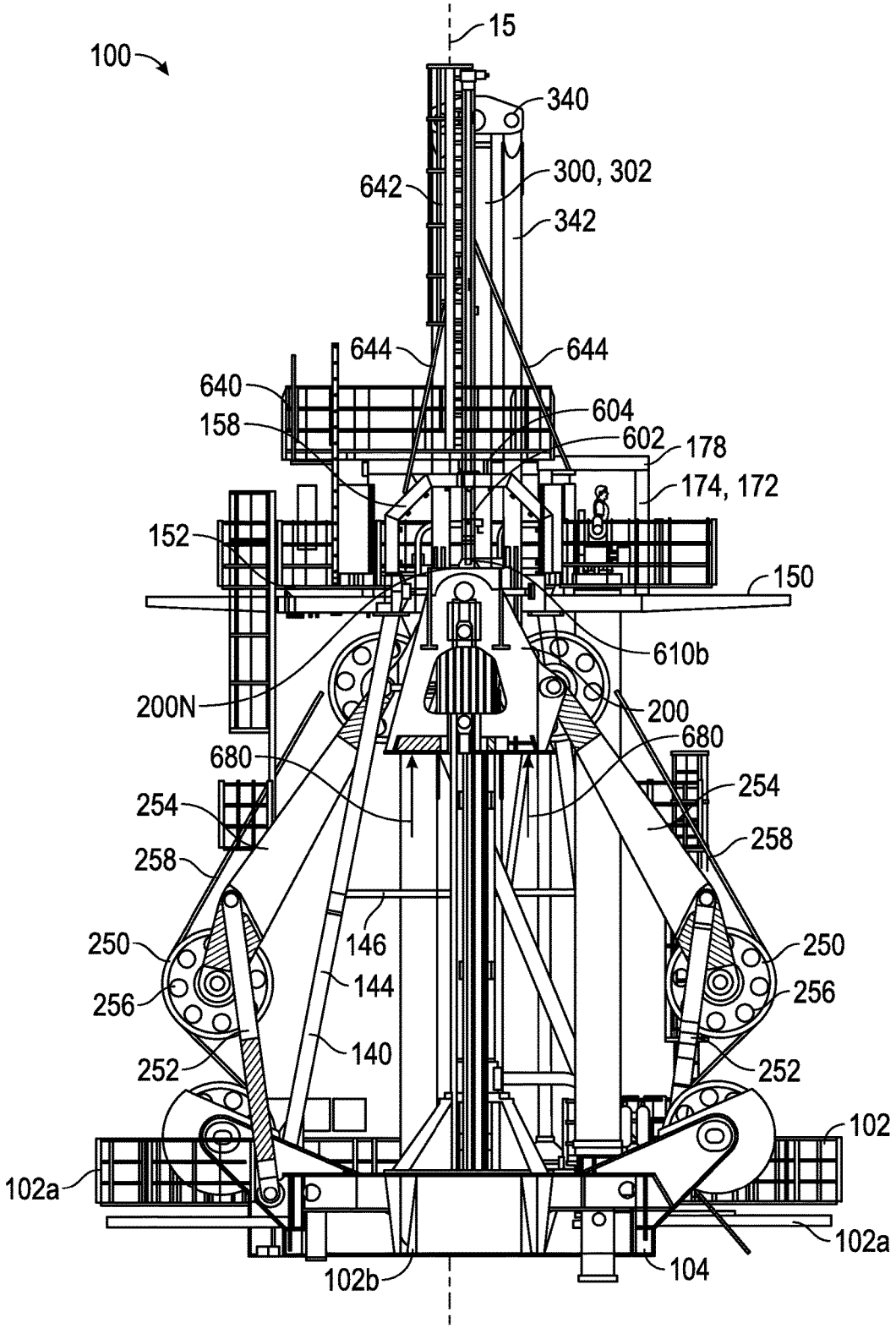
FIG. 16 is a side view of the heave compensation system of FIG. 2A illustrating a step of an embodiment of a method for removing an actuator of an active heave compensation assembly of the heave compensation system of FIG. 2A.
Figure 17:
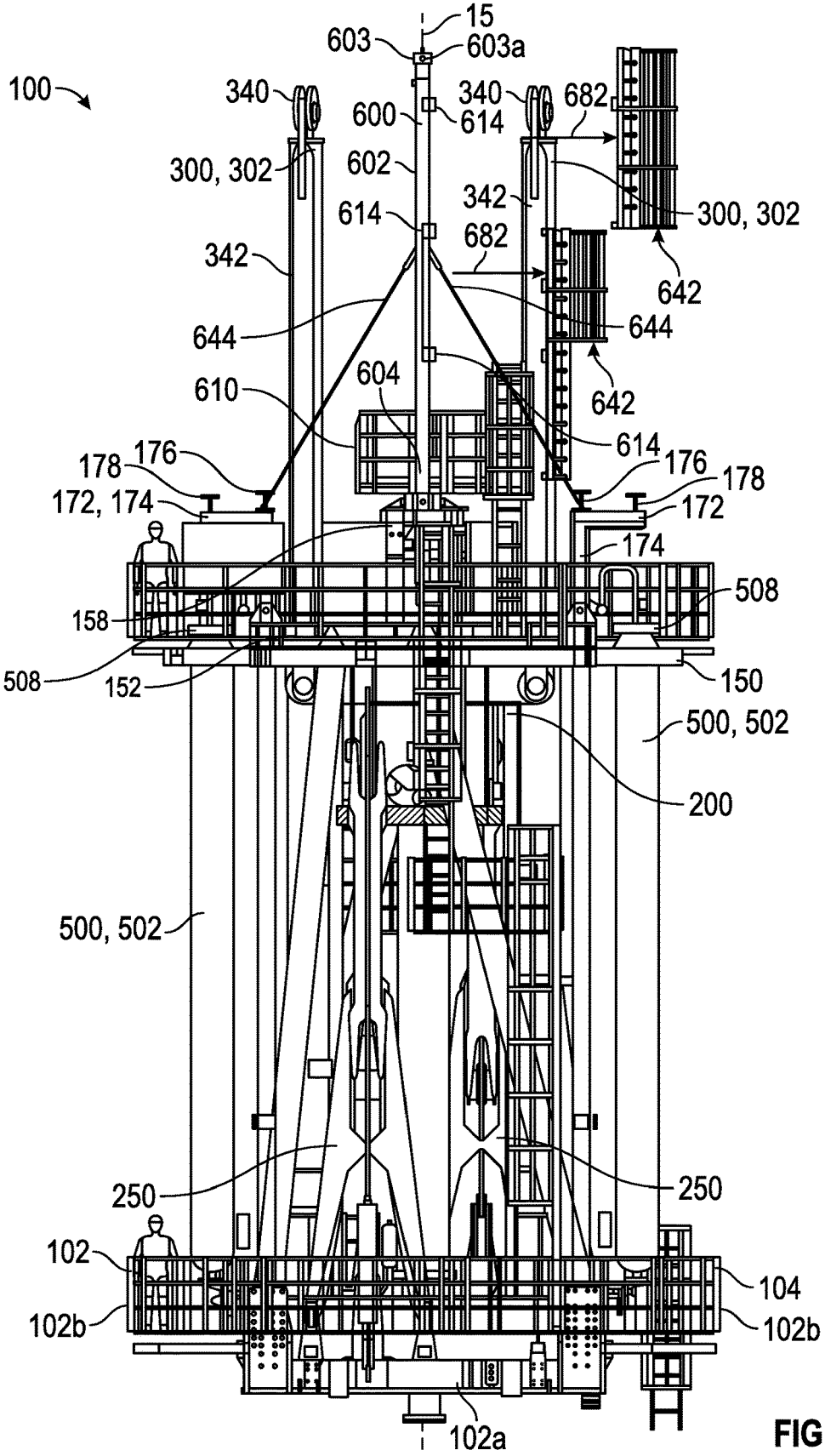
FIG. 17 is a front view of the heave compensation system of FIG. 2A illustrating another step of the method for removing an actuator of an active heave compensation system of FIG. 2A.
Figure 18A:
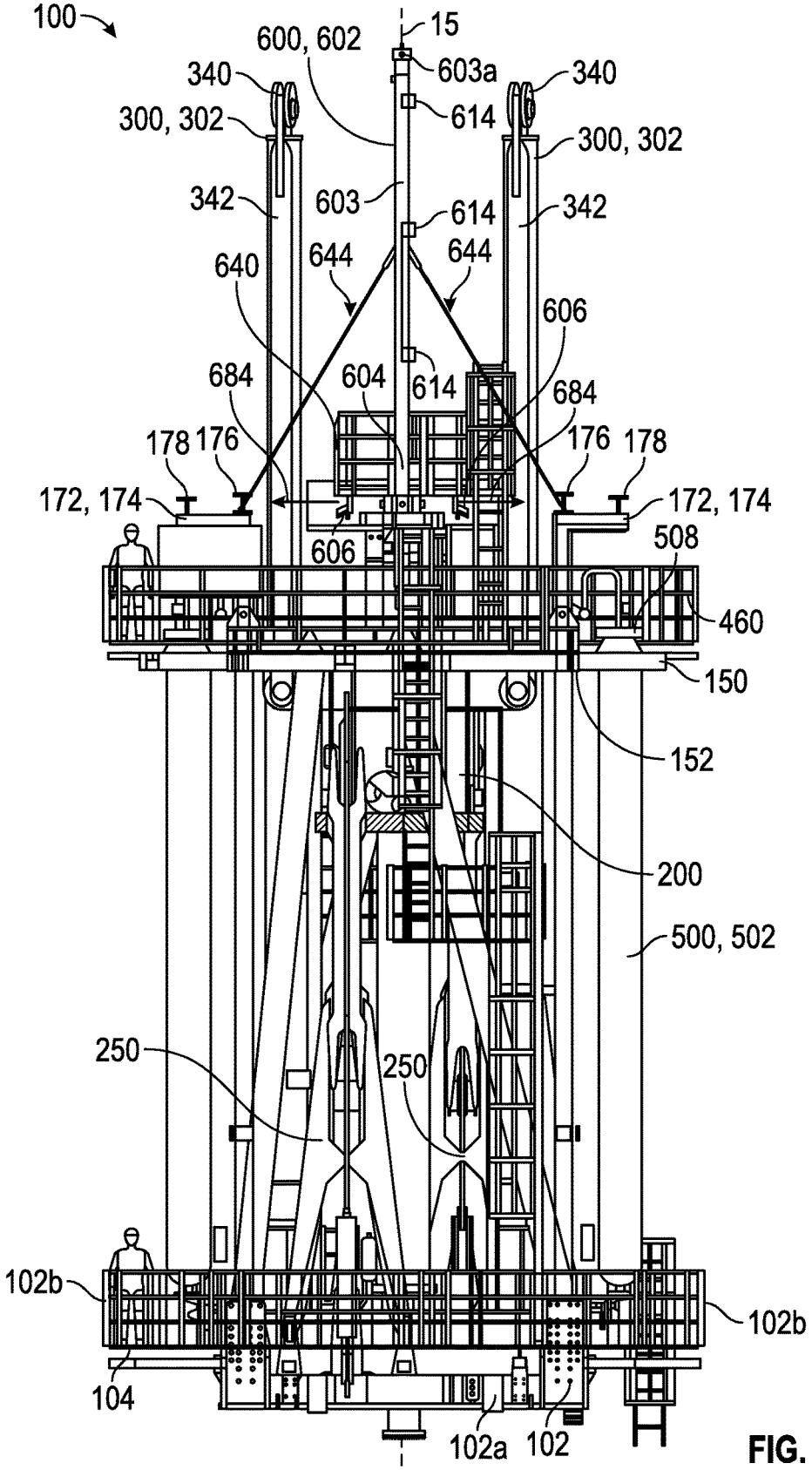
FIG. 18A is a front view of the heave compensation system of FIG. 2A illustrating another step of the method for removing an actuator of an active heave compensation system of FIG. 2A.
Figure 18B:
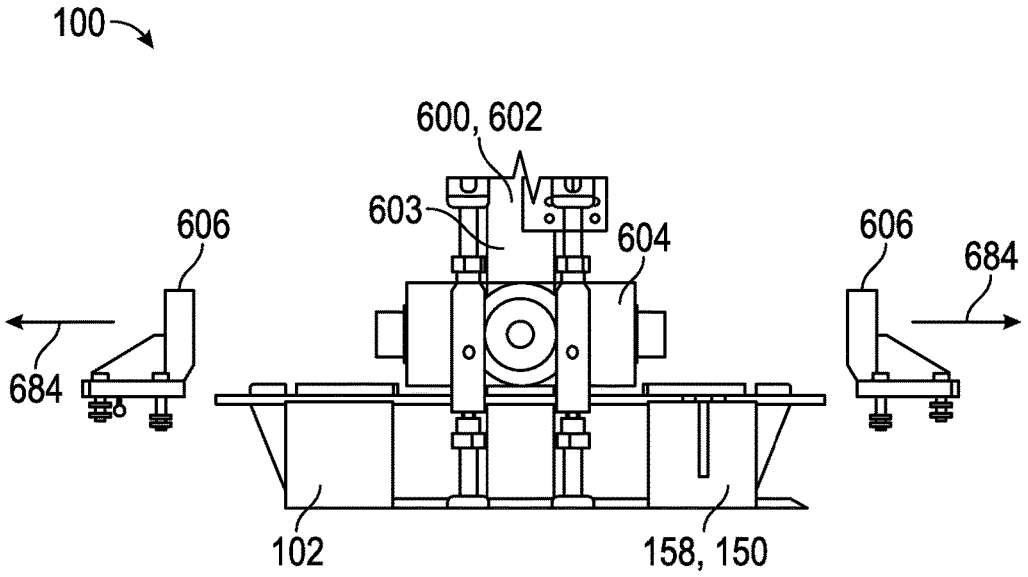
FIG. 18B is a zoomed-in side view of a cylinder of the actuator of FIG. 16, illustrating the step of FIG. 18A of the method for removing an actuator of an active heave compensation system of FIG. 2A.
Figure 19A:
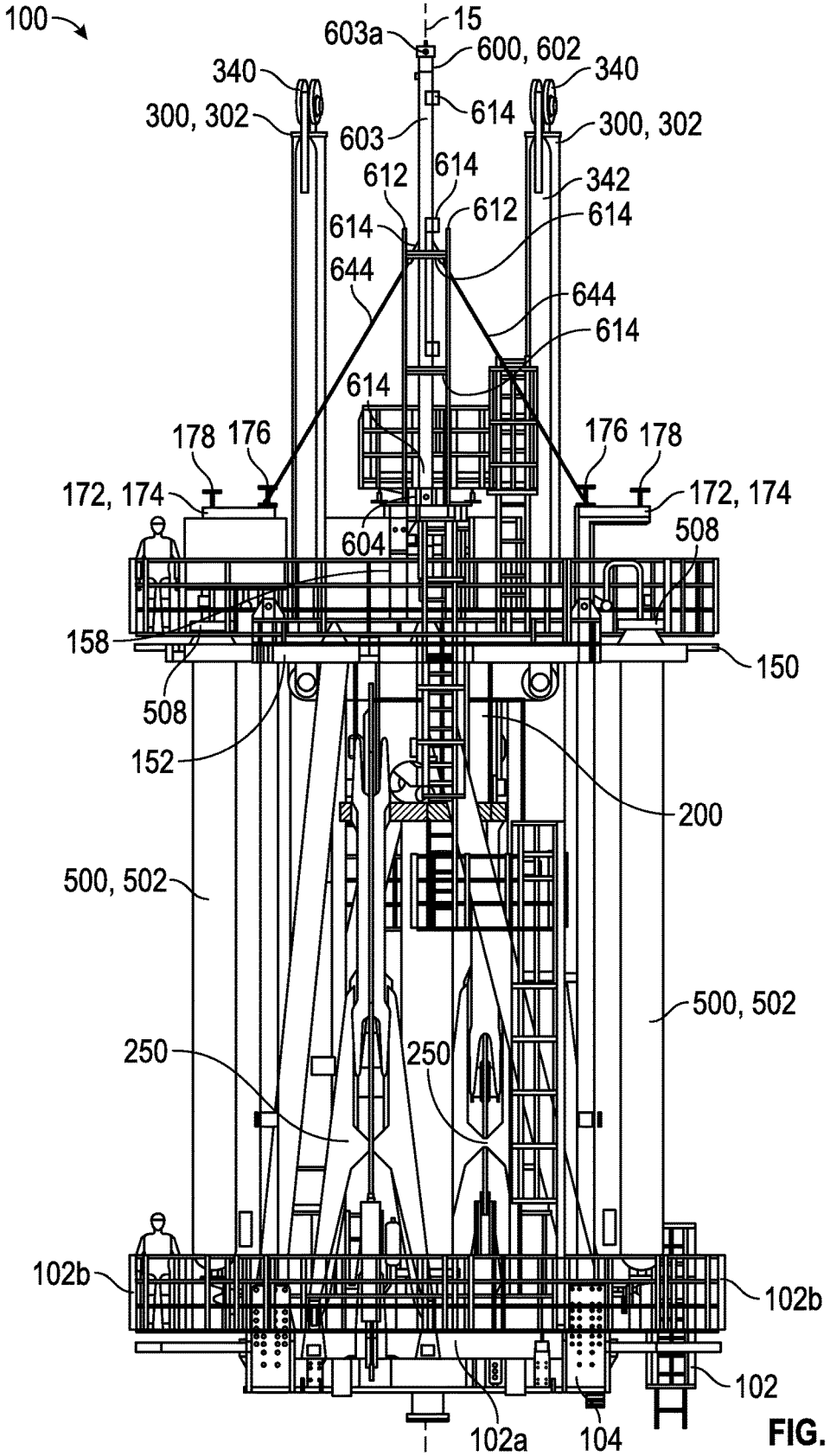
FIG. 19A is a front view of the heave compensation system of FIG. 2A illustrating another step of the method for removing an actuator of an active heave compensation system of FIG. 2A.
Figure 19B:
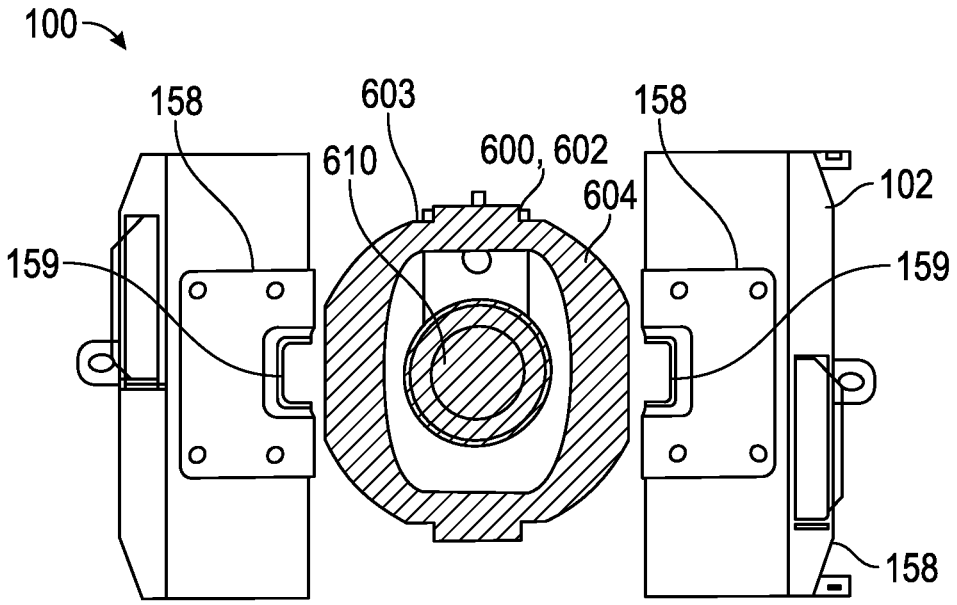
FIG. 19B is a zoomed-in, top cross-sectional view of the cylinder of the actuator of FIG. 16, illustrating the step of FIG. 19A of the method for removing an actuator of an active heave compensation system of FIG. 2A.

As shown in FIG. 16, to remove actuator 602 from heave compensation system 100 the crown block 200 is initially displaced into a longitudinally upper position, as indicated generally by arrows 680. In certain embodiments, crown block 200 is displaced into the longitudinally upper position by retracting piston 610 longitudinally upwards into cylinder 603, where the longitudinally lower end 610*b* of piston 610 is releasably coupled with the upper end of crown block 200 at hinged connection 200H. In some embodiments, crown block 200 is displaced into the longitudinally upper position by extending compensator cylinder assemblies 300. Following the displacement of crown block 200 into the longitudinally upper position shown in FIG. 16, ladders 642 of support structure 640 are removed to provide additional access to actuator 602, as indicated generally by arrows 682 in FIG. 17. In some embodiments, ladders 642 are unbolted from structure 640 and removed using soft slings or other mechanisms, and stored on upper frame 150 of support frame 102. While in this embodiment a method for removing actuator 602 includes removing ladders 642, in other embodiments, actuator 602 may be removed without removing ladders 642. In other embodiments, active heave compensation assembly 600 may not include ladders 642.

Once ladders 642 have been removed from structure 640, actuator 602 is decoupled from the upper frame 150 of support frame 102 to permit relative longitudinal movement between actuator 602 and support frame 102. In this embodiment, brackets 606 are decoupled from collar 604 of cylinder 603 and from C-frames 158 of upper frame 150, thereby decoupling actuator 602 from support frame 102, and removed from C-frames 158, as indicated generally by arrows 684 in FIGS. 18A and 18B. In certain embodiments, brackets 606 are unbolted from collar 604 and C-frames 158. Once brackets 606 are decoupled from collar 604 and C-frames 158, collar 604 and cylinder 603 are permitted to travel between the lateral open area or space extending between the pair of C-frames 158. In this configuration, the tension provided against actuator 602 by support cables 644 maintains actuator 602 in a substantially longitudinal position aligned with longitudinal axis 15.

Following the decoupling and removal of brackets 606 from the collar 604 of cylinder 603, a first or lower pair of circumferentially spaced and longitudinally extending guide plates 612 is releasably coupled with the cylinder 603 to facilitate guiding cylinder 603 through C-frames 158 of upper frame 150. In this embodiment, each pair of guide plates 612 are clamped to cylinder 603 of actuator 602, and thus, do not rely on mounts or brackets disposed on actuator 603 for coupling with cylinder 603. In this manner, guide plates 612 may be flexibly positioned along the longitudinal length of actuator 602. In this embodiment, the lower pair of guide plates 612 extend longitudinally upwards from a lower end at the lower end 603*b* of cylinder 603 at collar 604 to an upper end disposed between the upper and lower ends 603*a* and 603*b*, respectively, of cylinder 603.

Figure 20:
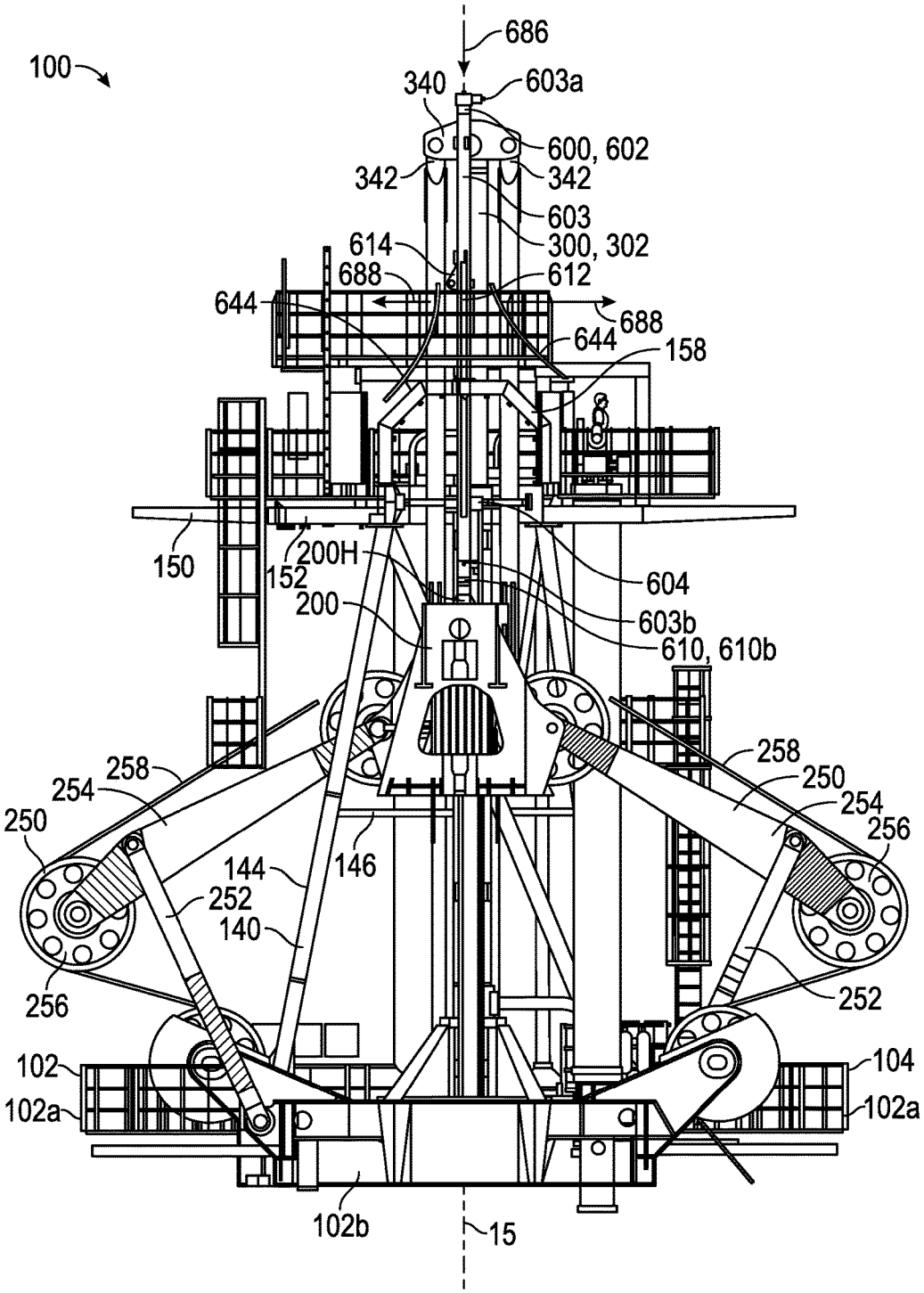
FIG. 20 is a side view of the heave compensation system of FIG. 2A illustrating another step of the method for removing an actuator of an active heave compensation system of FIG. 2A.

As shown particularly in FIG. 20, once the lower pair of guide plates 612 have been coupled with cylinder 603, crown block 200 and actuator 602 are lowered from the longitudinally upper position (indicated generally by arrow 686) towards the rig floor 12 (shown in FIG. 1) to provide access to the upper end 603*a* of cylinder 603 from structure 640 to complete the assembly or coupling of guide plates 612 to cylinder 603 of actuator 602. Additionally, support cables 644 are decoupled or released from the cylinder 603 of actuator 602 as indicated generally by arrows 688. With support cables 644 released from cylinder 603, actuator 602 is held or retained in the longitudinally extending position (aligned with longitudinal axis 15) via engagement between guide plates 612 and C-frames 158. As shown particularly in FIG. 21B, guide plates 612 are received within the slots 159 of each C-frame 158, restricting actuator 602 from pivoting about hinged connection 200H out of axial alignment with longitudinal axis 15.

Figure 21A:
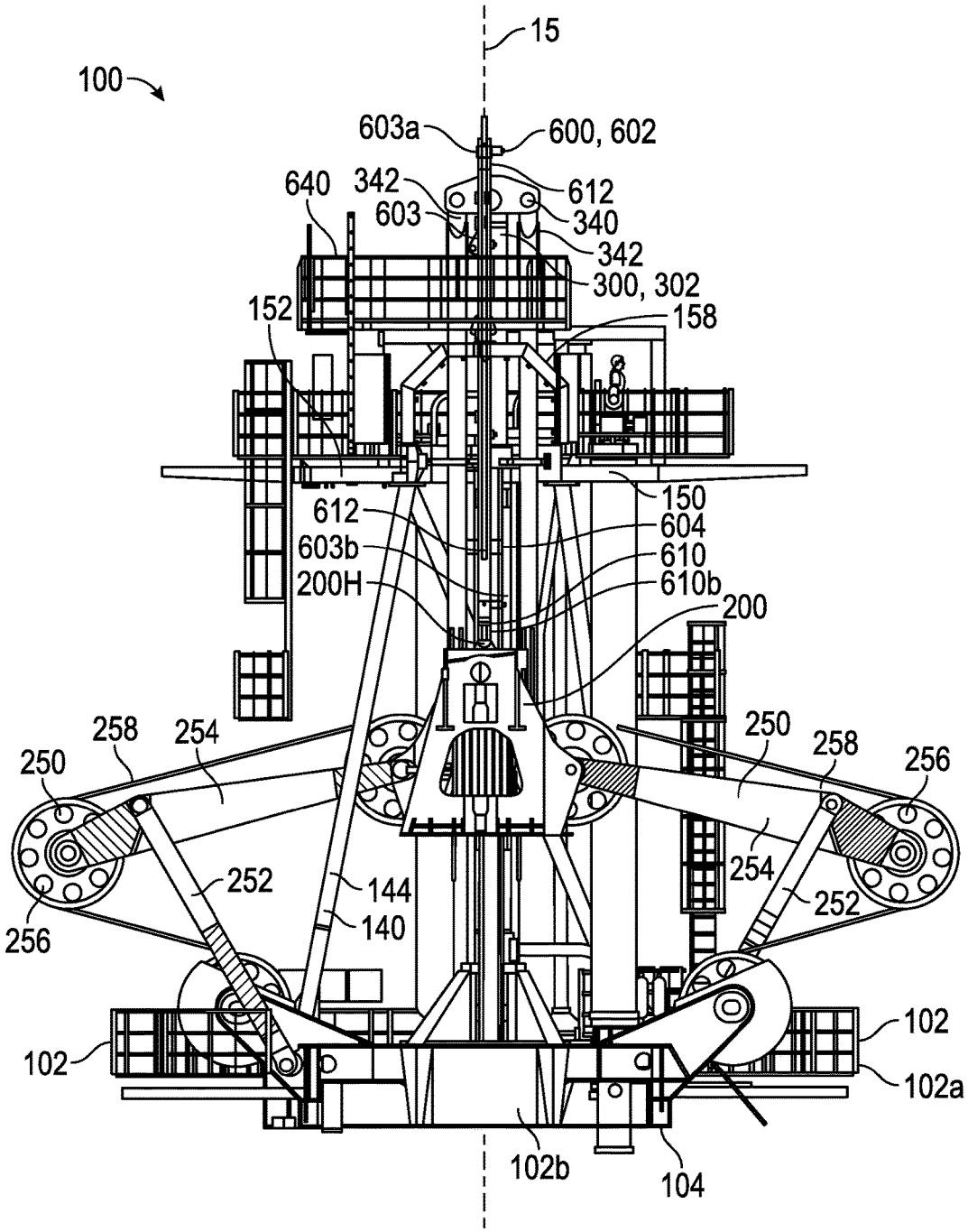
FIG. 21A is a side view of the heave compensation system of FIG. 2A illustrating another step of the method for removing an actuator of an active heave compensation system of FIG. 2A.
Figure 21B:
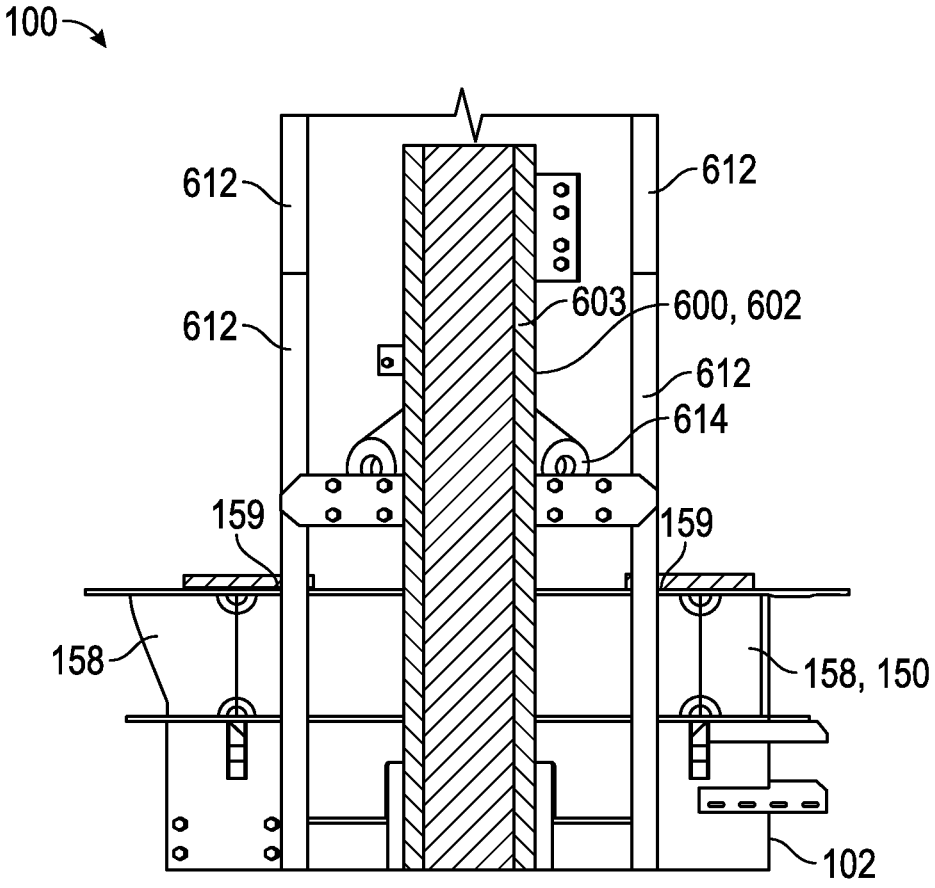
FIG. 21B is a zoomed-in, side cross-sectional view of the cylinder of the actuator of FIG. 16, illustrating the step of FIG. 21A of the method for removing an actuator of an active heave compensation system of FIG. 2A.

As shown particularly in FIGS. 21A and 21B, with support cables 644 released from cylinder 603 and the lower pair of guide plates 612 coupled to cylinder 603, the crown block 200 and actuator 602 are further lowered until the upper longitudinal end of the lower pair of guide plates 612 is disposed adjacent the upper end of C-frames 158. In this position, an upper longitudinal pair of additional guide plates 612 is releasably coupled to the cylinder 603 of actuator 602. In this embodiment, the upper pair of guide plates 612 extend from a lower end disposed directly adjacent the upper end of the lower pair of guide plates 612 to an upper end disposed proximal the upper end 603*a* of cylinder 603. As discussed above, both the upper and lower pairs of guide plates 612 are clamped to the outer surface of cylinder 603. In some embodiments, guide plates 612 are clamped to cylinder 603 using a two half-moon clamp system. In some embodiments, the lower end of each guide plate 612 of the upper pair of guide plates 612 is first coupled with cylinder 603, and the crown block 200 and actuator 602 are additionally lowered towards lower frame 104 in order to couple the upper end of each guide plate 612 of the upper pair of guide plates 612 to the upper end 603*a* of cylinder 603.

Figure 22:
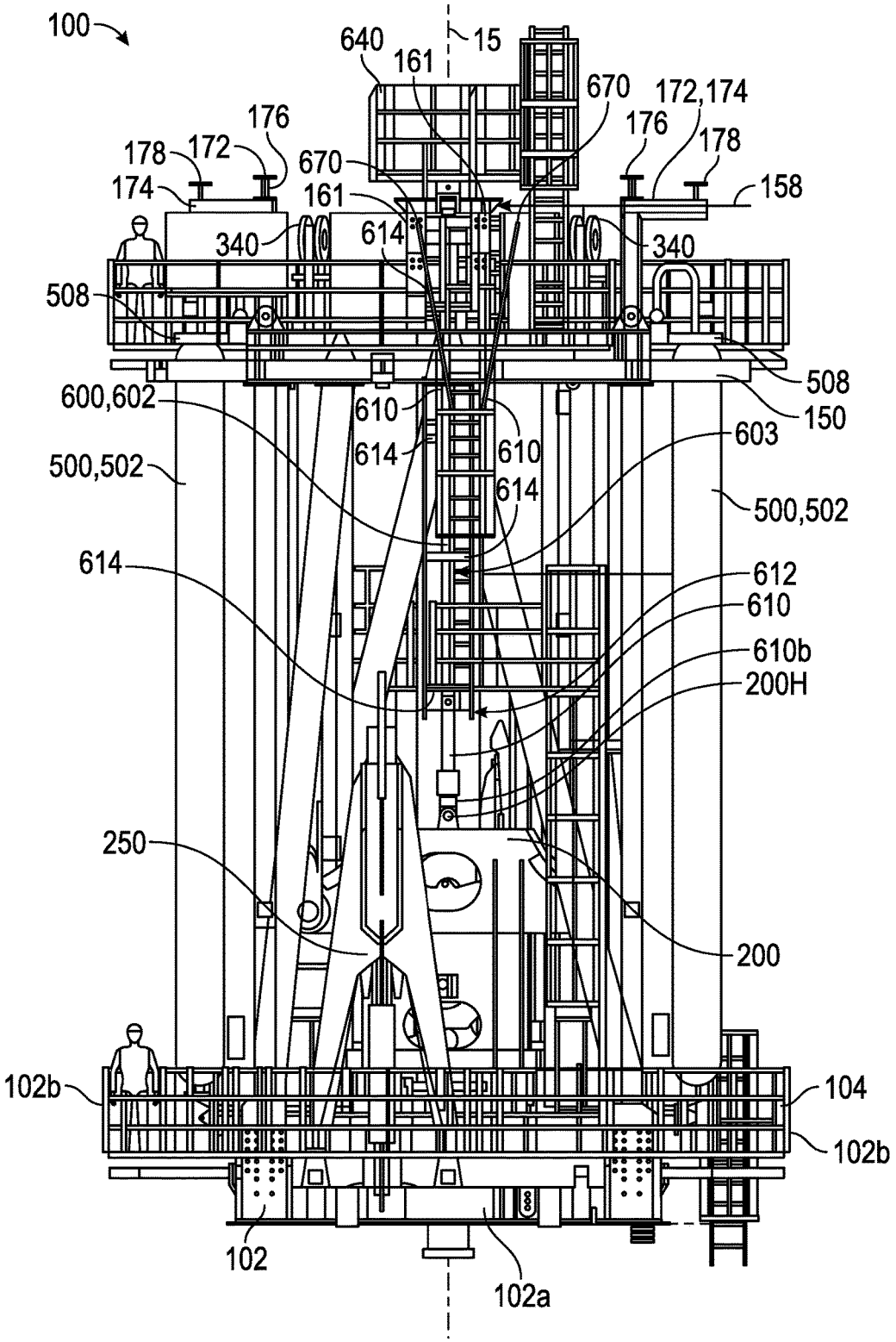
FIG. 22 is a front view of the heave compensation system of FIG. 2A illustrating another step of the method for removing an actuator of an active heave compensation system of FIG. 2A.
Figure 23:
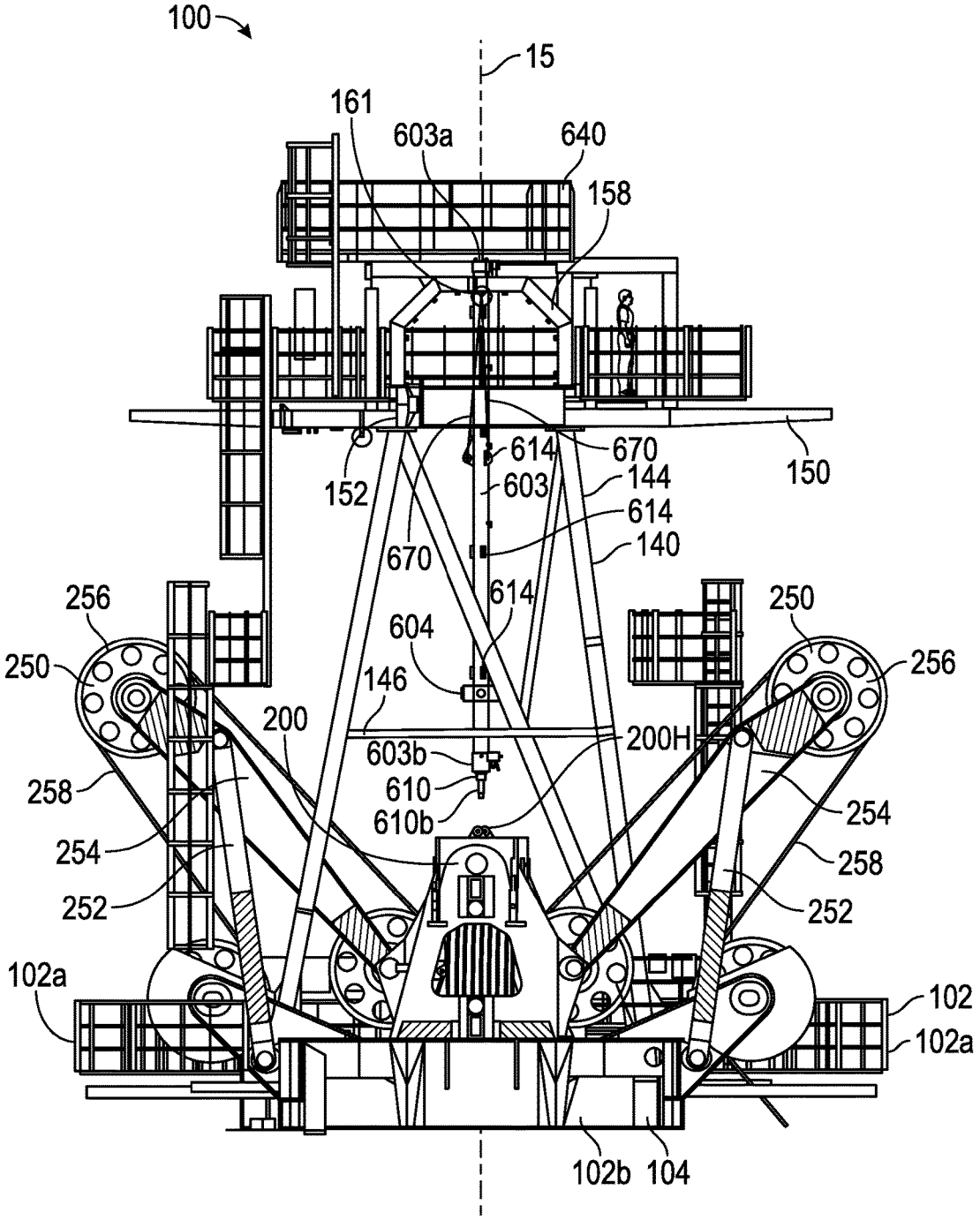
FIG. 23 is a side view of the heave compensation system of FIG. 2A illustrating another step of the method for removing an actuator of an active heave compensation system of FIG. 2A.

Once the upper and lower pairs of guide plates 612 are fully coupled with the cylinder 603 of actuator 602, the crown block 200 and actuator 602 are additionally lowered until the upper end 603*a* of cylinder 603 is disposed proximal the upper end of C-frames 158, as shown particularly in FIG. 22. In this position, one or more chain hoists or cables 670 are releasably coupled between a bracket 614 of cylinder 603 and a pair of lifting lugs 161 of C-frames 158. In this embodiment, lifting lugs 161 are positioned substantially equidistant between the lateral ends of C-frames 158 that couple with the upper surface 156 of inner rectangular frame 152 of the upper frame 150. Further, hoists 670 are coupled to a bracket 614 longitudinally spaced from both the upper end 603*a* and lower end 603*b* of cylinder 603. In this arrangement, actuator 602 is physically supported by or suspended from C-frames 158. Thus, in this arrangement the weight of actuator 602 is supported by upper frame 150 of support frame 102 via hoists 670. Following the coupling of hoists 670 with C-frames 158 and the cylinder 603 of actuator 602, the lower end 610*b* of piston 610 is disconnected from crown block 200 at hinged connection 200H, and the crown block 200 is further lowered into a longitudinally lower or rest position at the lower frame 104 of support frame 102, as shown particularly in FIG. 23. In this position, the upper end of crown block 200 is longitudinally spaced from the lower end 610*b* of piston 610.

Figure 24:
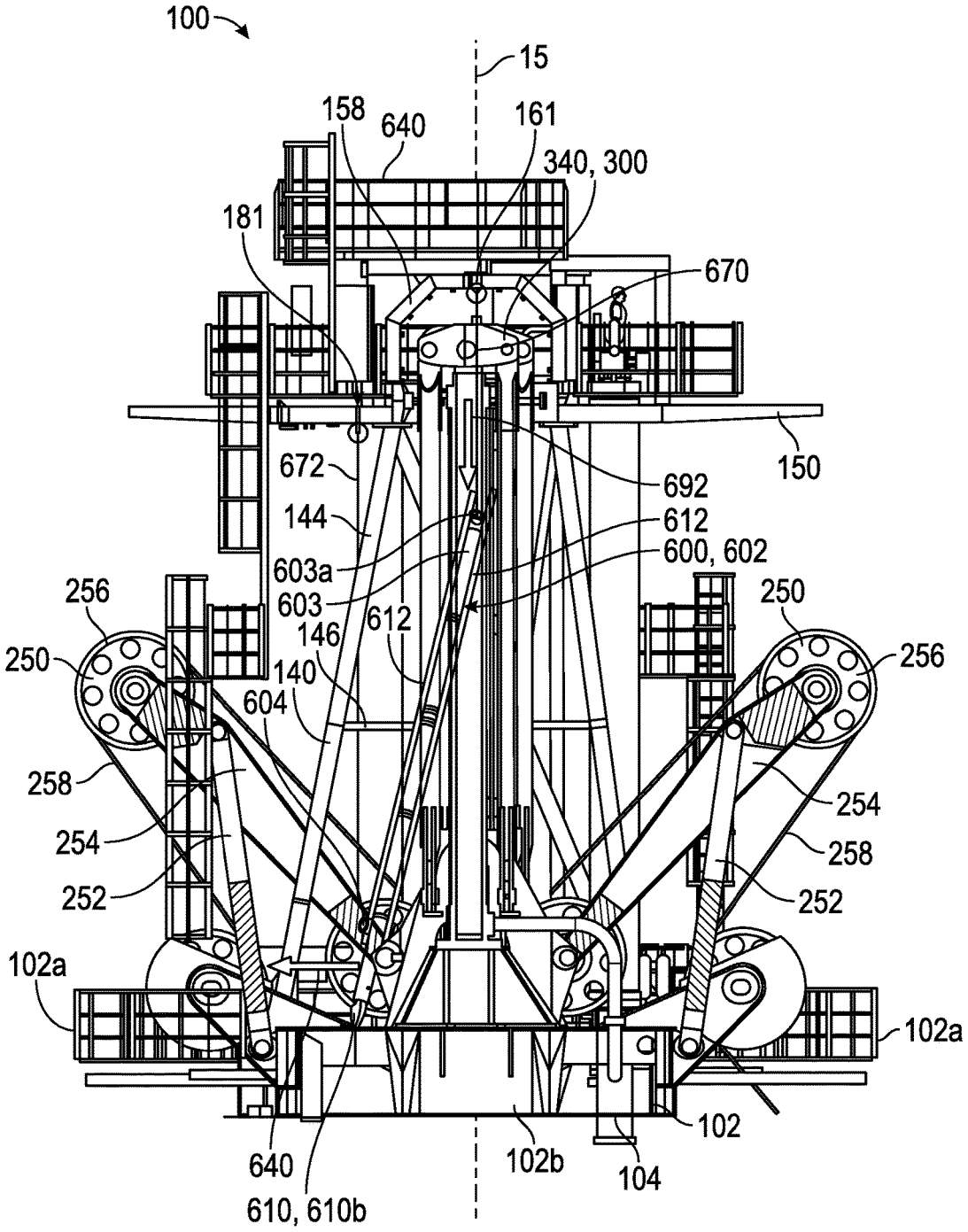
FIG. 24 is a side view of the heave compensation system of FIG. 2A illustrating another step of the method for removing an actuator of an active heave compensation system of FIG. 2A.
Figure 25:
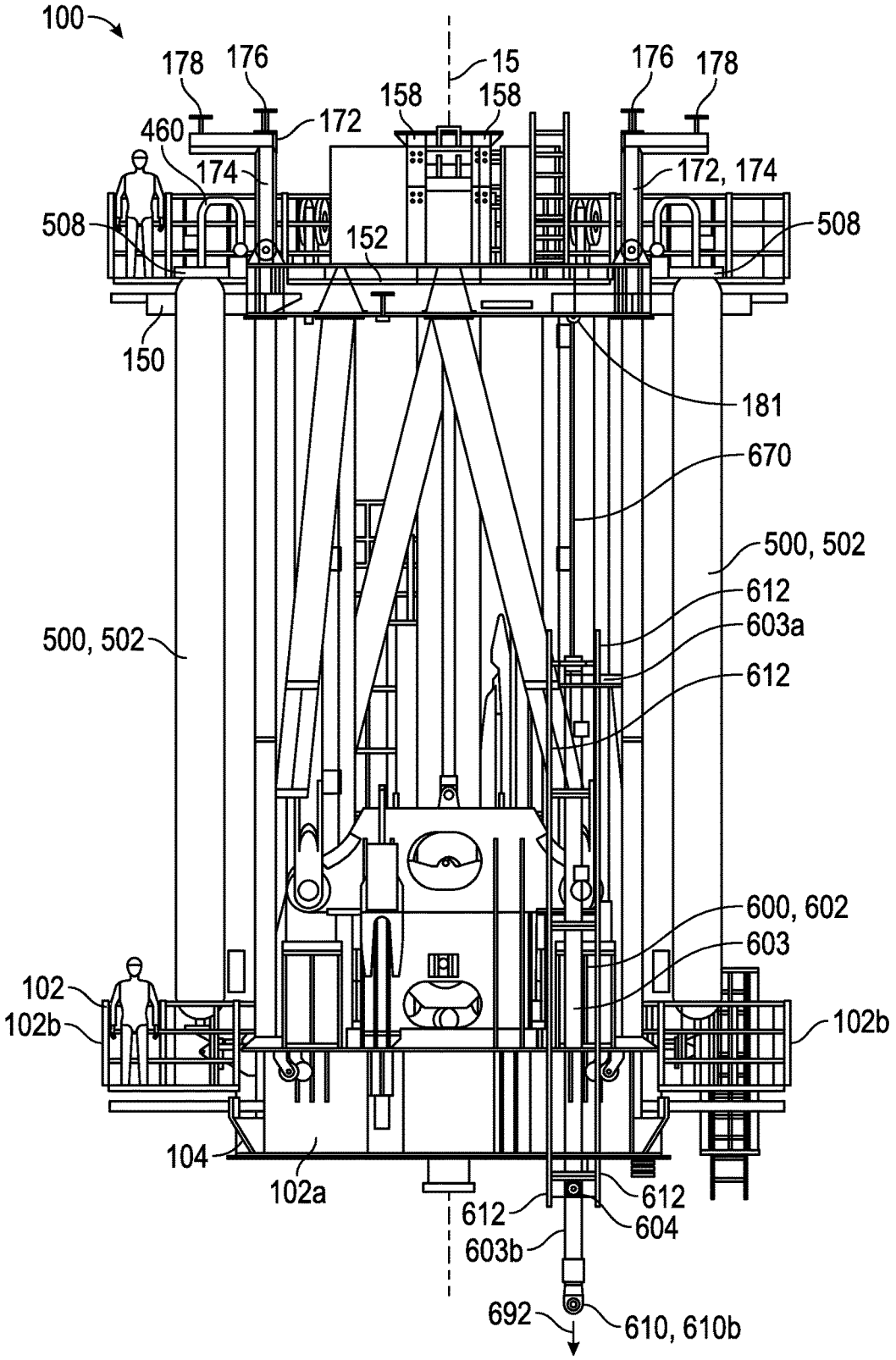
FIG. 25 is a front view of the heave compensation system of FIG. 2A illustrating another step of the method for removing an actuator of an active heave compensation system of FIG. 2A.

As shown particularly in FIG. 24, with actuator 602 disconnected from crown block 200, hoist 670 is coupled to a bracket 614 of cylinder 603 disposed at the upper end 603*a* of cylinder 603, and a second chain hoist or cable 672 is coupled between the lower lug 181 of upper frame 150 and a bracket 614 of cylinder 603 disposed at collar 604 proximal the lower longitudinal end 603*b*. In this arrangement, the longitudinally lower end of actuator 602 (i.e., the lower end 610*b* of piston 610) is pivoted (indicated generally by arrow 690) towards the second open area 114 of lower frame 104 that includes roller 118. The lower end of actuator 602 may be pivoted via a soft sling or other mechanism. Actuator 602 is then lowered through the second open area 114 (indicated generally by arrow 692 in FIGS. 24 and 25) via displacement of hoists 670 and 672 with roller 118 assisting in guiding actuator 602 therethrough, as shown in FIGS. 24 and 25. Actuator 602 is then lowered to the rig floor 12 of vessel 11 for refurbishment or replacement without needing to bring vessel 11 to shore. In some embodiments, actuator 602 may be subsequently replaced and assembled to form active heave compensation assembly 60 of heave compensation system 100 in a manner similar to, but reversed from the method described above for removing actuator 602 from system 100.

Thus, an embodiment of a method for removing a component of a heave compensation system comprises decoupling a cylinder (e.g., cylinder 603) of an active heave compensation actuator (e.g., actuator 602) from a support structure (e.g., support frame 102), wherein the active heave compensation actuator is configured to displace the crown block (e.g., crown block 200) relative to the support structure in response to a heave movement of the vessel (e.g., vessel 11), coupling a guide plate (e.g., guide plates 612) to a cylinder of the actuator, and displacing the guide plate through a slot (e.g., slot 159) extending into an actuator support beam (e.g., C-frame 158) of the support structure to guide the displacement of the actuator through the support structure.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A drilling system, comprising:

a drilling vessel comprising a rig floor;

a derrick extending from the rig floor of the drilling vessel along a longitudinal axis, wherein the derrick comprises a first end disposed at the rig floor and a second end longitudinally spaced from the first end; and a heave compensation system disposed at the second end of the derrick, the heave compensation system comprising:

a support structure comprising a first laterally extending frame coupled to the second end of the derrick, and a second laterally extending frame spaced from the first frame;

a crown block coupled to the support structure;

a transport assembly coupled to the second frame of the support structure, wherein the transport assembly comprises a first lifting lug; and a cylinder assembly supported by the first frame, wherein the cylinder assembly is releasably coupled with the crown block and configured to longitudinally displace the crown block relative to the support structure in response to a heave movement of the vessel;

wherein the transport assembly is configured to releasably couple with the cylinder assembly via a cable extending through the first lifting lug, and wherein the transport assembly is configured to support the weight of the cylinder assembly in response to the cylinder assembly being lowered from the first lifting lug to the rig floor through an internal volume of the derrick.

2. The drilling system of claim 1, wherein the transport assembly of the heave compensation system comprises:

a plurality of laterally spaced first support beams, wherein each first support beam extends longitudinally from the second frame of the support structure; and a laterally extending second support beam pivotably coupled to one of the plurality of laterally spaced first support beams;

wherein the first lifting lug extends from the second support beam.

3. The drilling system of claim 2, wherein the laterally extending second support beam is configured to pivot to a position intersecting a longitudinal axis of the cylinder assembly.

4. The drilling system of claim 1, wherein the support structure comprises a longitudinal structure coupled to the first frame and the second frame.

5. The drilling system of claim 4, wherein the longitudinal structure comprises:

a pair of angled support members coupled to the first frame and the second frame; and a cross-support member extending between the pair of angled support members, wherein the cross-support members is releasably coupled with the angled support members.

6. The drilling system of claim 1, wherein the first frame of the support structure comprises a first open area configured to provide space for the cylinder assembly to be displaced therethrough in response to the cylinder assembly in response to the lowering of the cylinder assembly towards the rig floor.

7. The drilling system of claim 1, wherein the heave compensation system further comprises:

a pedestal member releasably coupled to both an end of the cylinder assembly and the first frame of the support structure;

wherein the pedestal member is configured to be laterally displaced relative to the support structure in response to the cylinder assembly being lowered from the first lifting lug to the rig floor through the internal volume of the derrick.

8. The drilling system of claim 1, wherein the heave compensation system further comprises:

a vessel assembly supported by the first frame of the support structure, wherein the vessel assembly is configured to provide pressurized fluid to the cylinder assembly;

wherein the transport assembly is configured to releasably couple with the vessel assembly via a cable extending through a second lifting lug of the transport assembly, and wherein the transport assembly is configured to support the weight of the vessel assembly in response to the vessel assembly being lowered from the second lifting lug to the rig floor through the internal volume of the derrick.

9. The drilling system of claim 8, wherein the first frame of the support structure comprises a roller configured to guide the vessel assembly in response to the lowering of the vessel assembly towards the rig floor.

10. The drilling system of claim 8, wherein the transport assembly of the heave compensation system comprises:

a plurality of laterally spaced first support beams, wherein each first support beam extends longitudinally from the second frame of the support structure; and a laterally extending third support beam disposed on the plurality of laterally spaced first support beams;

wherein the second lifting lug extends from the third support beam.

11. The drilling system of claim 1, wherein the heave compensation system further comprises:

an active heave compensation actuator pivotably coupled to the crown block, wherein the actuator is configured to longitudinally displace the crown block relative to the support structure in response to a heave movement of the vessel;

wherein the transport assembly is configured to releasably couple with the actuator via a cable extending through a third lifting lug of the transport assembly, and wherein the transport assembly is configured to support the weight of the cylinder assembly in response to the cylinder assembly being lowered from the third lifting lug to the rig floor through the internal volume of the derrick.

12. The drilling system of claim 11, wherein the heave compensation system further comprises:

a pair of laterally spaced active heave support beams coupled to the second frame of the support structure, wherein each active heave support frame comprises a slot extending therein; and a guide plate coupled to the actuator;

wherein, in response to the lowering of the actuator to the rig floor, the guide plate is configured to be displaced through the slots of the active heave support beams to guide the actuator towards the rig floor.

* * * * *